US011049469B2

(12) United States Patent
Sasaki et al.

(10) Patent No.: US 11,049,469 B2
(45) Date of Patent: Jun. 29, 2021

(54) DATA SIGNAL LINE DRIVE CIRCUIT AND LIQUID CRYSTAL DISPLAY DEVICE PROVIDED WITH SAME

(71) Applicant: Sharp Kabushiki Kaisha, Sakai (JP)

(72) Inventors: Yasushi Sasaki, Sakai (JP); Yuhichiroh Murakami, Sakai (JP); Shige Furuta, Sakai (JP); Takahiro Yamaguchi, Sakai (JP); Hiroyuki Adachi, Sakai (JP); Shuji Nishi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/063,740

(22) Filed: Oct. 6, 2020

(65) Prior Publication Data

US 2021/0150999 A1 May 20, 2021

Related U.S. Application Data

(60) Provisional application No. 62/937,291, filed on Nov. 19, 2019.

(51) Int. Cl.
*G09G 3/36* (2006.01)

(52) U.S. Cl.
CPC ... *G09G 3/3688* (2013.01); *G09G 2300/0842* (2013.01); *G09G 2310/0286* (2013.01)

(58) Field of Classification Search
CPC ..... G09G 2310/027; G09G 2310/0283; G09G 2330/021; G09G 3/3688; G09G 3/3233; G09G 3/3677; G09G 3/3696; G09G 2300/0842; G09G 2300/0857
See application file for complete search history.

(56) References Cited

U.S. PATENT DOCUMENTS

2001/0022581 A1* 9/2001 Koyama ..... G09G 3/3688 345/204
2002/0158857 A1* 10/2002 Iisaka ..... G09G 3/3648 345/204
2003/0090481 A1* 5/2003 Kimura ..... G09G 3/3266 345/211
2006/0227092 A1* 10/2006 Nose ..... G09G 3/3614 345/98
2010/0123704 A1 5/2010 Nishimizu et al.
2011/0148842 A1* 6/2011 Nakayama ..... G09G 3/3688 345/211

FOREIGN PATENT DOCUMENTS

JP 2010-122509 A 6/2010

* cited by examiner

*Primary Examiner* — Dong Hui Liang
(74) *Attorney, Agent, or Firm* — Keating & Bennett, LLP

(57) ABSTRACT

A data signal line drive circuit includes: a shift register including a plurality of unit circuits; a first latch portion including a plurality of first latch circuits; and a second latch portion including a plurality of second latch circuits. Here, the k-th (k is a natural number) second latch circuit is provided with first latch signals provided to (k+1)-th and subsequent first latch circuits as a second latch signal, so that the capturing of data signals at the second latch portion is split into two or more timings.

5 Claims, 27 Drawing Sheets

DATA SIGNAL LINE DRIVE CIRCUIT AND LIQUID CRYSTAL DISPLAY DEVICE PROVIDED WITH SAME

CROSS-REFERENCE TO RELATED APPLICATIONS

This application claims the benefit of priority to U.S. Provisional Application No. 62/937,291 filed on Nov. 19, 2019. The entire contents of the above-identified application are hereby incorporated by reference.

BACKGROUND

Technical Field

The following disclosure relates to a data signal line drive circuit of a liquid crystal display device, and particularly relates to a data signal line drive circuit of a liquid crystal display device including memory circuits in pixel circuits.

In recent years, liquid crystal display devices provided with memory circuits in pixel circuits have been developed in order to reduce power consumption. Such a liquid crystal display device is referred to as "memory liquid crystal" or the like. In general, in the memory liquid crystal, one bit of data can be held for each pixel, and in a case where an image of the same content or an image with a little change is displayed for a long period of time, image display is performed by using the data held in the memory circuit. In the memory liquid crystal, once the data is written to the memory circuit, the contents of the data written to the memory circuit are then held until rewritten. Thus, little power is consumed in periods other than the periods before and after the contents of the image change. Therefore, low power consumption can be achieved by the memory liquid crystal.

Incidentally, a circuit that supplies a data signal to a pixel circuit in the memory liquid crystal is referred to as a "binary driver". FIG. 26 is a circuit block diagram illustrating a configuration of a portion of a known binary driver. Note that, it is also assumed here that there are 1600 source bus lines (data signal lines) that are driven for every 16 lines. It is also assumed that binary data is written to each of the source bus lines. A portion corresponding to the source bus lines from the (16z−15)-th line to the 16z-th line is referred to as a "z-th stage" with z as an integer greater than or equal to 1 and smaller than or equal to 100. For example, a portion corresponding to the source bus lines from the 33-th line to the 48-th line is referred to as a "third stage". A reference sign, for example, SL <1:16>, such as in FIG. 26 denotes a data signal output to the source bus lines from the first line to the 16-th line.

The binary driver is constituted with a shift register 910 including 100 unit circuits 91 (1) to 91 (100), a first latch portion 920 constituted with 100 first latch circuits 92 (1) to 92 (100), and a second latch portion 930 constituted with 100 second latch circuits 93 (1) to 93 (100). Note that FIG. 26 illustrates constituent elements from the first stage to the fourth stage.

Each of the first latch circuits 92 includes 16 unit latch circuits corresponding to the 16 source bus lines, respectively. Similarly, each of the second latch circuits 93 includes 16 unit latch circuits corresponding to the 16 source bus lines, respectively. The unit latch circuits employ D latch circuits, referred to as "pass-through latches", "gated D latches" and the like. The unit latch circuit captures a data signal, based on an enable signal EN and outputs the captured data signal. Note that, hereinafter, a signal provided as an enable signal EN to the first latch circuit 92 is referred to as a "first latch signal", and a signal provided as an enable signal EN to the second latch circuit 93 is referred to as a "second latch signal".

Each of the unit circuits 91 in the shift register 910 operates based on a binary start pulse signal BSP and two-phased binary clock signals BCK and BCKB. The output signal LTEN from each of the unit circuits 91 is provided as a set signal S to the unit circuit 91 at the next stage, and is provided as the first latch signal described above to the corresponding first latch circuit 92. Each of the first latch circuits 92 captures a data signal DATA transmitted from the outside, based on the first latch signal, and outputs the captured data signal. Each of the second latch circuits 93 captures the data signal output from the corresponding first latch circuit 92, based on the second latch signal and outputs the captured data signal to a corresponding source bus line. Note that, as can be understood from FIG. 26, all of the second latch circuits 93 (1) to 93 (100) are given the same signal EN2 as the second latch signal.

FIG. 27 is a signal waveform diagram for describing the operation of the known binary driver. Note that numerical values listed in a column of the data signal DATA <1:16> indicates in what stage the data is. Here, data corresponding to a value greater than or equal to 1 or smaller than or equal to 100 is valid data. The numerical values listed in the columns of the binary clock signals BCK and BCKB represent of what stage of data the pulse contribute to the capturing.

After the pulse generation of the binary start pulse signal BSP, in a case where the binary clock signal BCK rises first, the output signal LTEN (1) from the unit circuit 91 (1) at the first stage is set to the high level. As a result, the first latch circuit 92 (1) at the first stage captures the data signal DATA transmitted from the outside. Next, in a case where the binary clock signal BCKB rises, the output signal LTEN (2) from the unit circuit 91 (2) at the second stage is set to the high level. As a result, the first latch circuit 92 (2) at the second stage captures the data signal DATA transmitted from the outside. In this way, in each of the first latch circuits 92, the data signal DATA is captured based on the output signal LIEN from the corresponding unit circuit 91. Then, in a case where the output signal LTEN (100) from the unit circuit 91 (100) at the 100-th stage is set to the high level, the data signal DATA has been captured by all of the first latch circuits 92 (1) to 92 (100). In such a state, the second latch signal EN2 is set to the high level at the time point tx. As described above, this second latch signal EN2 is provided in common to all of the second latch circuits 93 (1) to 93 (100). In this way, the capturing of the data signal in all of the second latch circuits 93 (1) to 93 (100) is performed in unison. Then, the data signal SL is output in unison to all of the source bus lines. In this regard, the source bus lines are connected to the pixel circuits and the wiring line capacity is large, and a number of source bus lines are disposed in a display portion. Thus, by the data signals being output in unison to all the source bus lines, a large current flows, resulting in a voltage drop (drop in power supply voltage) (see a section labeled with the reference signs 98 and 99 in FIG. 27). Such a voltage drop may have an undesirable effect on the operation of the internal circuit and may be a factor of malfunction. Driving at a low voltage (e.g., 3 V) is often performed in the memory liquid crystal, and thus the memory liquid crystal is particularly susceptible to voltage drop.

A technique for reducing the effect of voltage drop as described above is disclosed in JP 2010-122509 A. Specifically, it is described that a delay circuit (see FIG. 3 and FIG. 5 of JP 2010-122509 A) is provided so as to generate time differences in the data capturing timing between a plurality of second latch groups in a case where data is captured by the plurality of second latch groups. However, it is difficult to generate a large time difference in data capturing timing by this technique. Thus, before the power supply returns from a voltage drop occurred due to capturing of data in a certain second latch group, capturing of data in a next second latch group may be performed in some cases. In this case, the voltage drop will occur again before the power supply returns, so the effect of reducing the effect of the voltage drop is less effective. Although it is possible to increase the time difference in data capturing timing by increasing the number of inverters that constitute the delay circuit, the increase in the number of inverters causes an increase in circuit size. As the number of inverters increases, the effect of process variation increases, which makes control difficult.

SUMMARY

Therefore, an object of the following disclosure is to realize a binary driver (data signal line drive circuit) that can effectively reduce the effect of voltage drop while suppressing an increase in circuit size.

(1) A data signal line drive circuit according to some embodiments of the disclosure is a data signal line drive circuit including:

a shift register including a plurality of unit circuits connected in series;

a first latch portion including a plurality of first latch circuits configured to operate based on two power supply voltages; and a second latch portion including a plurality of second latch circuits configured to operate based on two power supply voltages, the data signal line drive circuit being configured to output data signals to a plurality of data signal lines, wherein each of the plurality of first latch circuits captures a data signal transmitted from outside, based on a first latch signal, and outputs the captured data signal, each of the plurality of second latch circuits captures a data signal output from a corresponding first latch circuit, based on a second latch signal, and outputs the captured data signal to a corresponding data signal line, each of the plurality of first latch circuits is provided with a shift pulse output from a corresponding unit circuit as the first latch signal, and first latch signals provided to (k+1)-th and subsequent first latch circuits are given as the second latch signal to a k-th second latch circuit, as capturing of data signals at the second latch portion is split into two or more timings, with k as a natural number.

According to such a configuration, the capturing of the data signals (data signals output from the first latch portion) in the second latch portion is performed by dividing into two or more timings instead of being performed in unison. In other words, the output timings of the data signals to the plurality of data signal lines are distributed. As a result, the size of the voltage drop caused by the output of the data signals to the data signal lines is significantly smaller than in the related art. Because no delay circuit is provided in the data signal line drive circuit, the time difference of the capturing timings of the data signals can be increased without increasing the circuit size. In the configuration described above, a data signal line drive circuit is realized that can effectively reduce the effect of voltage drop while suppressing an increase in circuit size.

(2) A data signal line drive circuit according to some embodiments of the disclosure includes the configuration of (1) described above, wherein a first latch signal provided to a (k+p)-th first latch circuit is provided as the second latch signal to the k-th second latch circuit, with p as a particular natural number.

(3) A data signal line drive circuit according to some embodiments of the disclosure includes the configuration of (1) described above, wherein a same signal is provided as the second latch signal to continuous q second latch circuits, with q as an integer greater than or equal to 2.

(4) A data signal line drive circuit according to some embodiments of the disclosure includes the configuration of (1) described above, wherein the data signals represent binary data.

(5) A liquid crystal display device according to some embodiments of the disclosure includes:

a plurality of pixel circuits including memory circuits configure to hold data, based on the data signals;

a plurality of data signal lines configured to supply the data signals to the plurality of pixel circuits; and a data signal line drive circuit according to any configuration of (1) to (4) described above.

These and other objects, features, aspects, and advantages of the disclosure will become more apparent from the following detailed description of the disclosure with reference to the accompanying drawings.

BRIEF DESCRIPTION OF DRAWINGS

The disclosure will be described with reference to the accompanying drawings, wherein like numbers reference like elements.

DESCRIPTION OF EMBODIMENTS

Embodiments will be described below with reference to the accompanying drawings. The liquid crystal display device described in each of the following embodiments is a liquid crystal display device called the "memory liquid crystal" described above.

1. First Embodiment

1.1 Overall Configuration and Schematic Operation

Figure 2:
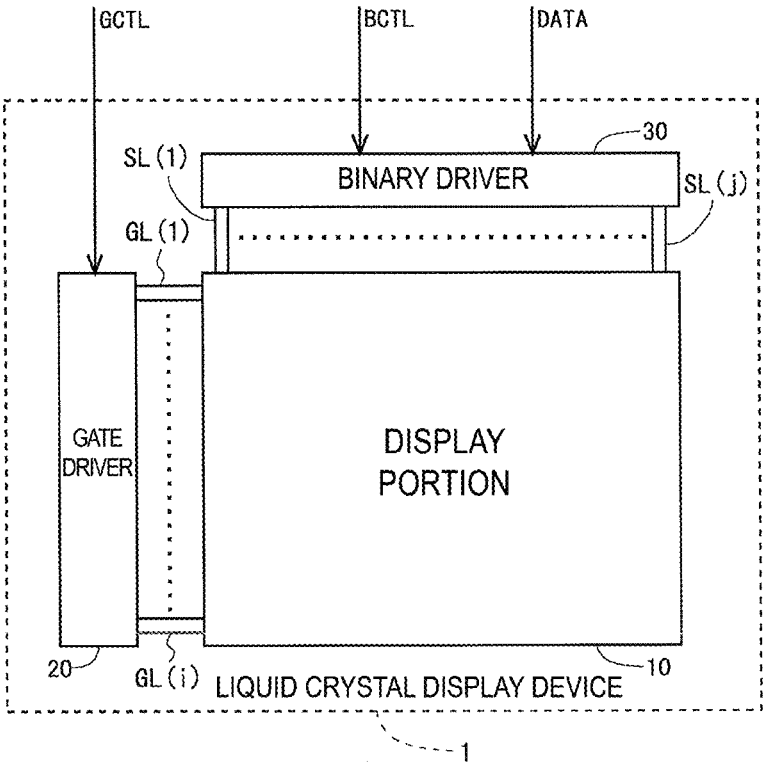
FIG. 2 is a block diagram illustrating an overall configuration of a liquid crystal display device according to the first embodiment.

FIG. 2 is a block diagram illustrating an overall configuration of a liquid crystal display device 1 according to a first embodiment.

Figure 3:
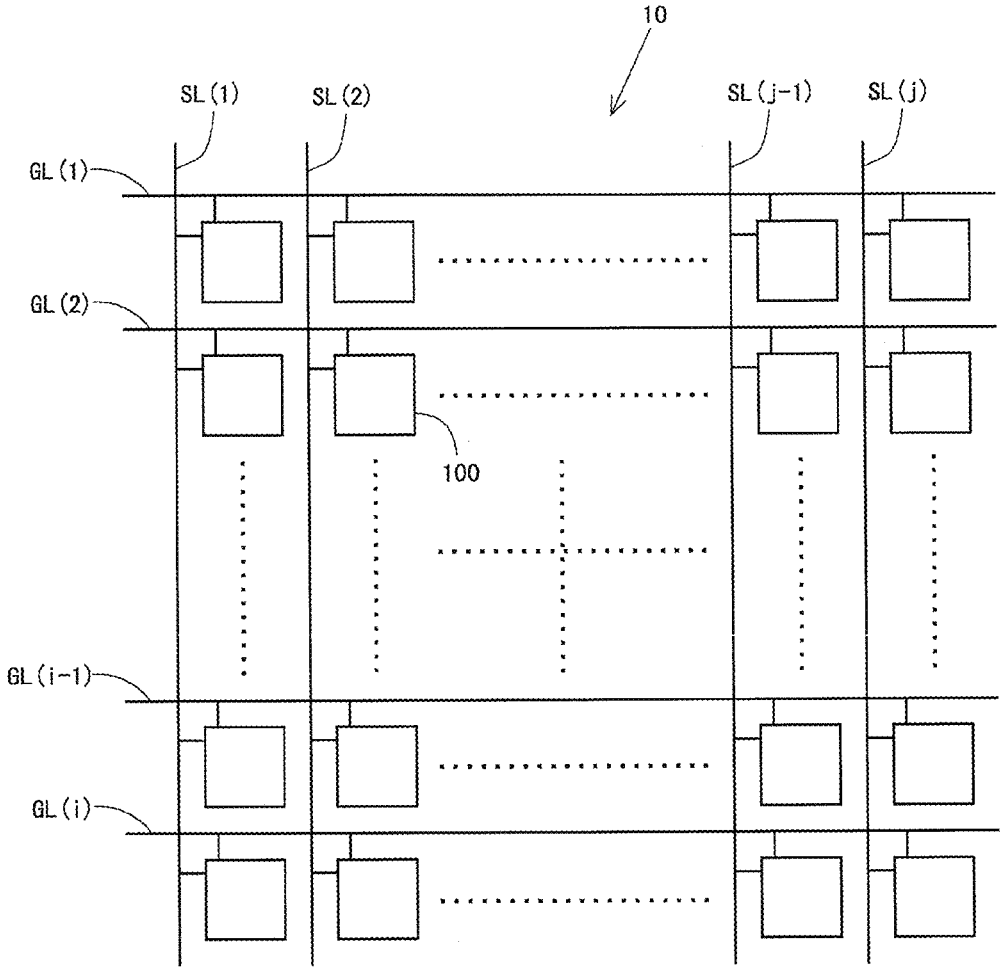
FIG. 3 is a diagram for describing a configuration of a display portion according to the first embodiment.

As illustrated in FIG. 2, the liquid crystal display device 1 includes a display portion 10, a gate driver (scanning signal line drive circuit) 20, and a binary driver (data signal line drive circuit) 30. In the display portion 10, as illustrated in FIG. 3, a plurality of (i) gate bus lines (scanning signal lines) GL (1) to GL (i), a plurality of (j) source bus lines (data signal lines) SL (1) to SL (j), and a plurality of (i*j) pixel circuits 100 each provided corresponding to the intersections of the plurality of gate bus lines GL (1) to GL (i) and the plurality of source bus lines SL (1) to SL (j) are formed. Note that a detailed configuration of the pixel circuits 100 will be described later.

The gate driver 20 drives the gate bus lines GL (1) to GL (i), based on a gate control signal GCTL transmitted from the outside. The gate control signal GCTL includes a gate start pulse signal and a gate clock signal. The operation of the gate driver 20 typically applies active scanning signals sequentially one at a time to the i gate bus lines GL, in each vertical scanning period. The binary driver 30 receives a binary control signal BCTL and a data signal DATA transmitted from the outside, and applies the data signal to the j source bus lines SL (1) to SL (j). The detailed configuration and operation of the binary driver 30 will be described later. Note that the gate control signal GCTL and the binary control signal BCTL may be generated by a timing generator in the liquid crystal display device 1.

As described above, by the data signal being applied to each of the source bus lines SL (1) to SL (j), and the scanning signal being applied to each of the gate bus lines GL (1) to GL (i), an image is displayed to the display portion 10. Note that in the following, the data signal applied to the source bus lines is also denoted by the reference sign SL, and the scanning signal applied to the gate bus lines is also denoted by reference sign GL.

1.2 Pixel Circuit

Figure 4:
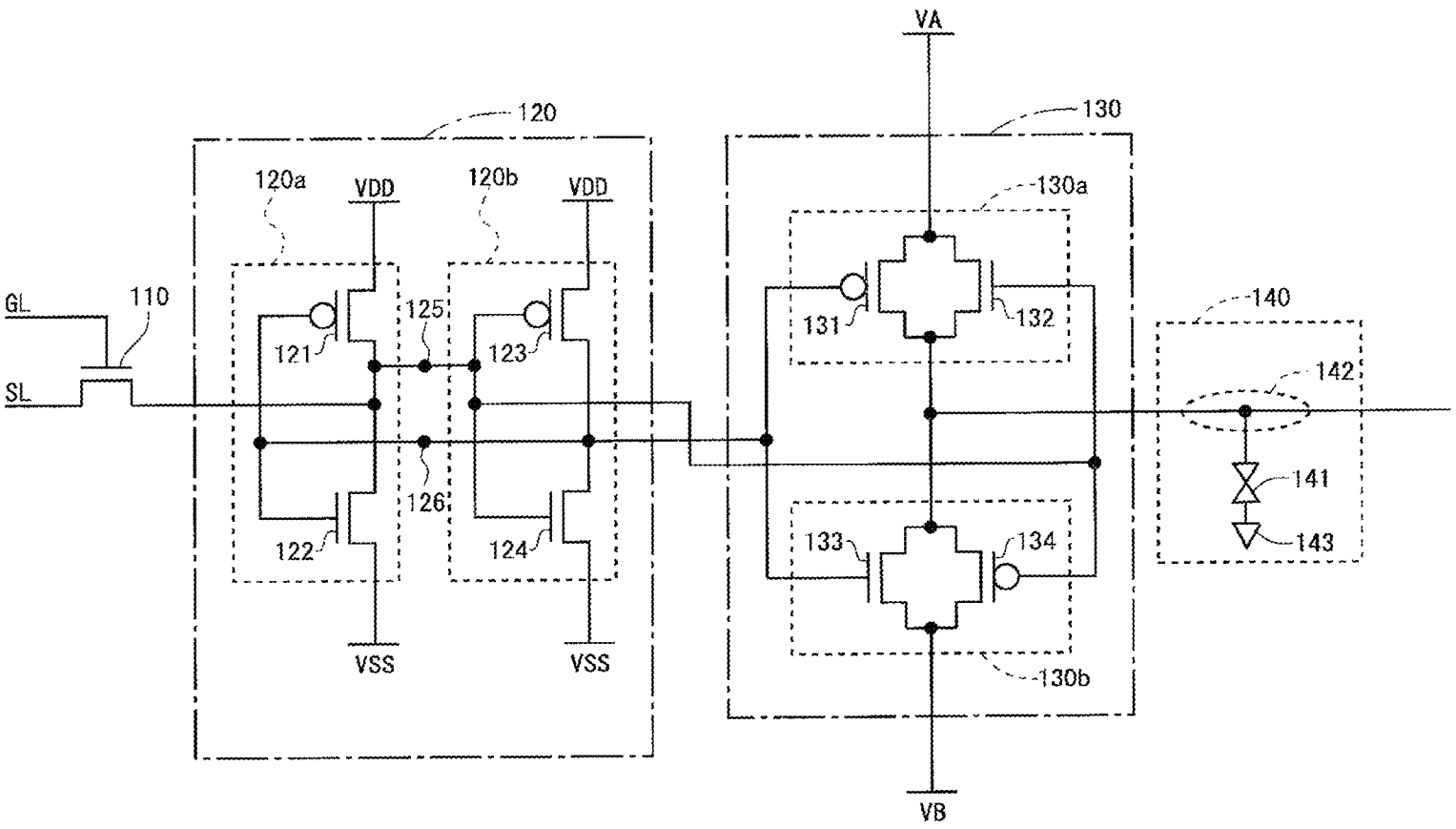
FIG. 4 is a circuit diagram illustrating a detailed configuration of a pixel circuit in the display portion according to the first embodiment.

FIG. 4 is a circuit diagram illustrating a detailed configuration of one pixel circuit 100 in the display portion 10. Note that the configuration illustrated in FIG. 4 is merely an example, and no such limitation is intended. As illustrated in FIG. 4, the pixel circuit 100 in the present embodiment includes a switch 110, a memory circuit 120, a liquid crystal drive voltage application circuit 130, and a display element portion 140. The pixel circuit 100 is supplied with the scanning signal GL, the data signal SL, the high-level power source voltage VDD, the low-level power source voltage VSS, the white display voltage VA, and the black display voltage VB.

The switch 110 is a n-channel type transistor. The switch 110 is in the on state in a case where the scanning signal GL is at the high level. In a case where the switch 110 is in the on state, the source bus line SL and the node 125 in the memory circuit 120 are electrically connected via the switch 110. In the configuration described above, in a case where the scanning signal GL is at the high level, the potential of the data signal SL is provided to the node 125.

The memory circuit 120 is constituted by a CMOS inverter 120*a* including a p-channel type transistor 121 and an re-channel type transistor 122, and a CMOS inverter 120*b* including a p-channel type transistor 123 and an n-channel type transistor 124. For the CMOS inverter 120*a*, the input terminal is connected to the node 126, and the output terminal is connected to the node 125. For the CMOS inverter 120*b*, the input terminal is connected to the node 125, and the output terminal is connected to the node 126. In the configuration described above, the memory circuit 120 functions to hold a value (logic value) based on the potential provided to the node 125 in a case where the switch 110 is in the on state until the next time the switch 110 is in the on state.

The liquid crystal drive voltage application circuit 130 is constituted by a CMOS switch 130*a* including a p-channel type transistor 131 and an n-channel type transistor 132, and a CMOS switch 130*b* including an n-channel type transistor 133 and a p-channel type transistor 134. The CMOS switch 130*a* is in the on state in a case where the potential of the node 125 is at the high level and the potential of the node 126 is at the low level. In a case where the CMOS switch 130*a* is in the on state, a white display voltage VA is provided to the pixel electrode 142. The CMOS switch 130*b* is in the on state in a case where the potential of the node 125 is at the low level and the potential of the node 126 is at the high level. In a case where the CMOS switch 130*b* is in the on state, a black display voltage VB is provided to the pixel electrode 142.

The display element portion 140 is constituted by a liquid crystal 141, a pixel electrode 142, and a common electrode 143. A voltage is applied to the liquid crystal, based on the voltage applied to the pixel electrode 142 and the voltage applied to the common electrode 143, and the liquid crystal application voltage is reflected in the display state of the pixel.

Figure 5:
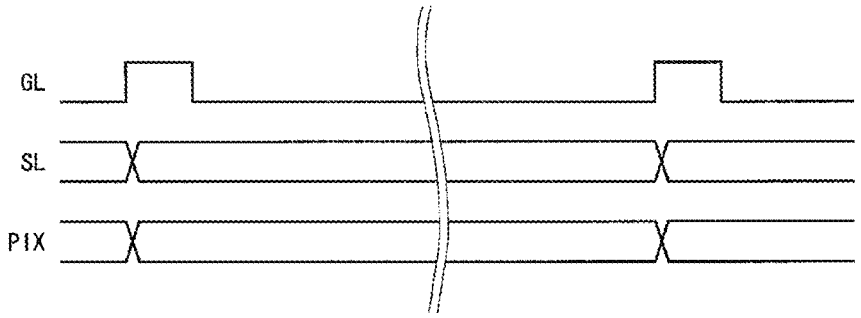
FIG. 5 is a signal waveform diagram for describing the operation of the pixel circuit according to the first embodiment.

According to the pixel circuit 100 configured as described above, in a case where the scanning signal GL applied to the corresponding gate bus line is at the high level, the binary data is held in the memory circuit 120, based on the potential of the data signal SL that is being applied to the corresponding source bus line (see FIG. 5). In the liquid crystal drive voltage application circuit 130, the display voltage to be applied to the pixel electrode 142 (either the white display voltage VA or the black display voltage VB) is selected based on the binary data held in the memory circuit 120. Then, the selected display voltage is applied to the pixel electrode 142 (see the waveform of the reference sign PIX in FIG. 5), and the display state of the pixel becomes a white display or a black display.

Note that a CMOS switch including a p-channel type transistor and an n-channel type transistor may be provided instead of an n-channel type transistor as the switch 110. An n-channel type transistor may be provided instead of the CMOS switch 130*a*, and an n-channel type transistor may be provided instead of the CMOS switch 130*b*.

1.3 Configuration of Binary Driver

Figure 6:
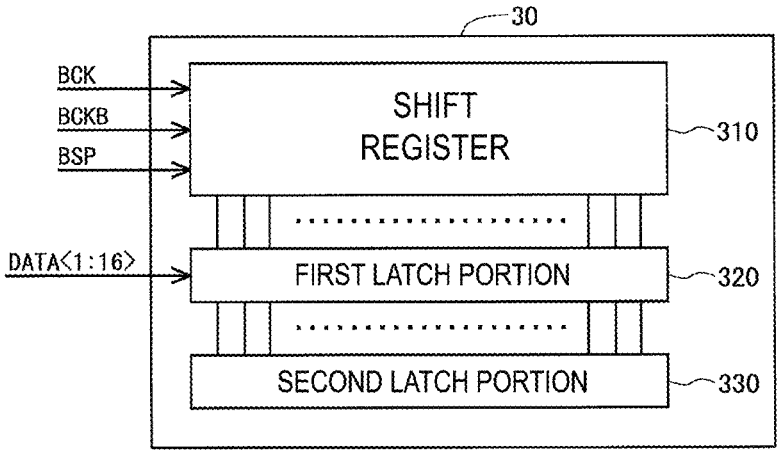
FIG. 6 is a block diagram illustrating a schematic configuration of the binary driver according to the first embodiment.

FIG. 6 is a block diagram illustrating a schematic configuration of the binary driver 30. As illustrated in FIG. 6, the binary driver 30 includes a shift register 310, a first latch portion 320, and a second latch portion 330. The shift register 310 is provided with a binary start pulse signal BSP and binary clock signals BCK and BCKB from the outside as the binary control signal BCTL. The first latch portion 320 is provided with a data signal DATA from the outside. Note that in the present embodiment, the data signal DATA is composed of 16 pieces of data of 1 bit.

Figure 1:
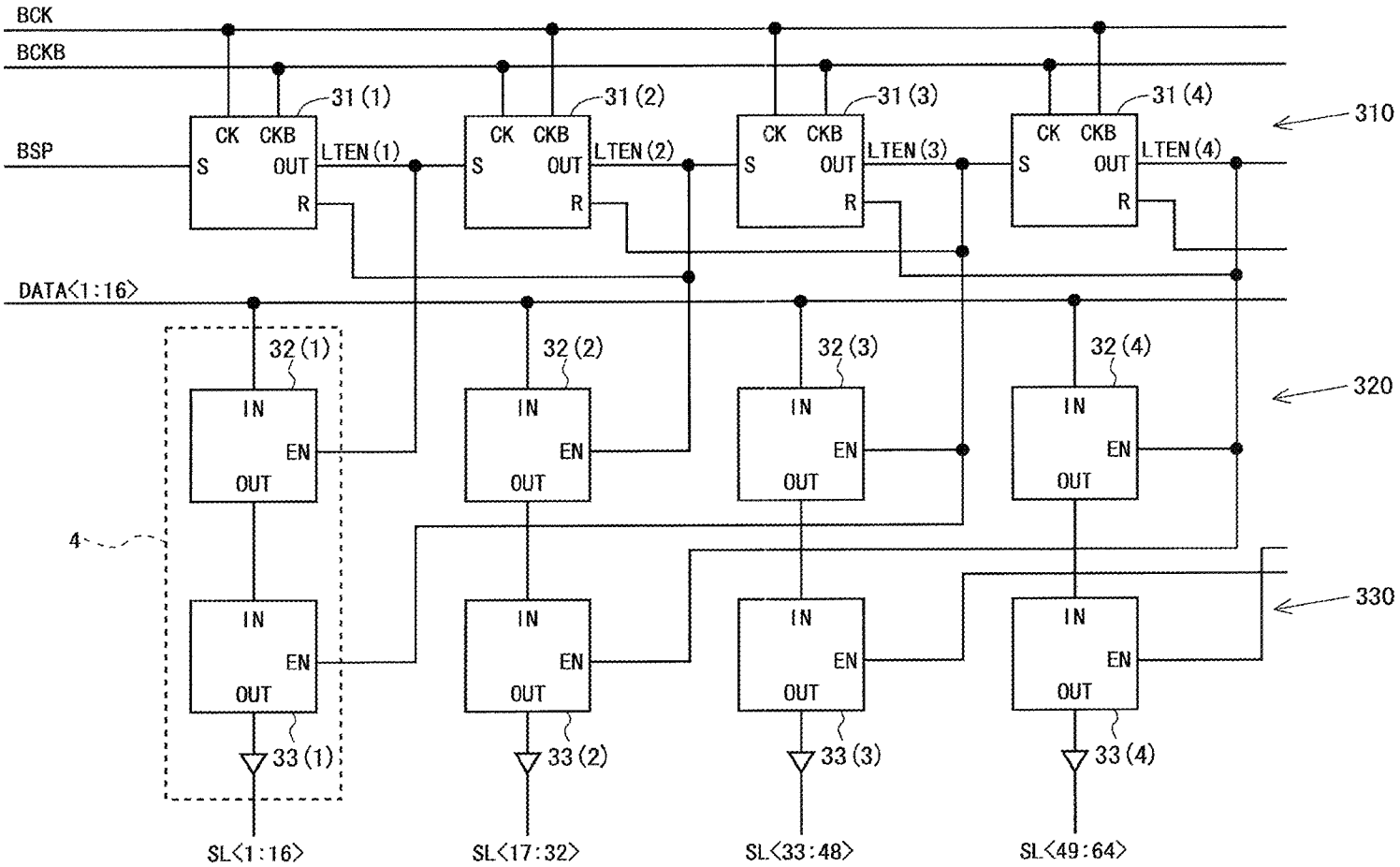
FIG. 1 is a circuit block diagram illustrating a configuration of a portion of a binary driver according to a first embodiment.

FIG. 1 is a circuit block diagram illustrating a configuration of a portion of the binary driver 30 according to the present embodiment. Note that FIG. 1 illustrates constituent elements from the first stage to the fourth stage. It is also assumed here that there are 1600 source bus lines that are driven for every 16 lines. The binary driver 30 is constituted with the shift register 310 constituted with 104 unit circuits 31 (1) to 31 (104), for example, connected in series, the first latch portion 320 constituted with 100 first latch circuits 32 (1) to 32 (100), and the second latch portion 330 constituted with 100 second latch circuits 33 (1) to 33 (100).

Figure 8:
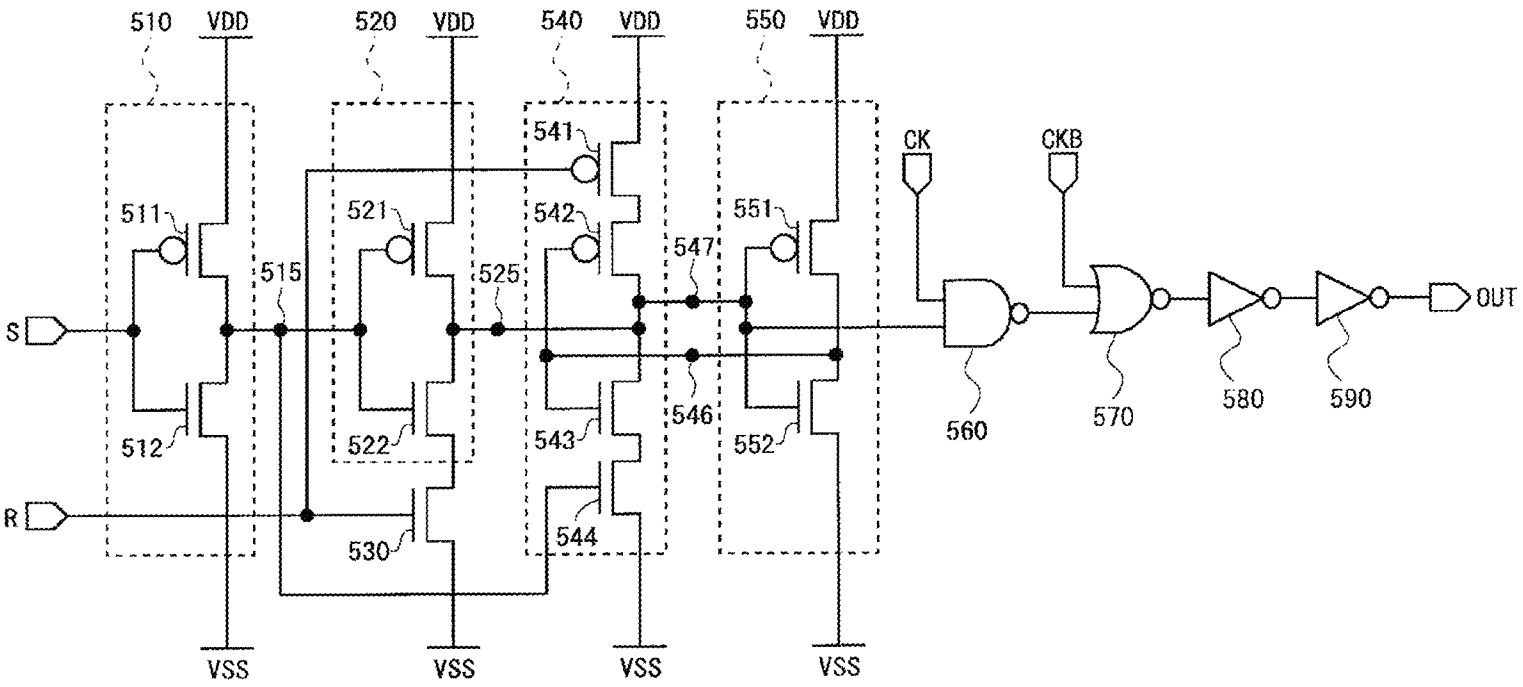
FIG. 8 is a circuit diagram illustrating a configuration of one stage of a shift register (configuration of a unit circuit) according to the first embodiment.

Here, a configuration of one stage of the shift register 310 (the configuration of the unit circuit 31) will be described with reference to FIG. 8. Note that the configuration described hereinafter is merely an example, and no such limitation is intended. As illustrated in FIG. 8, the unit circuit 31 includes: a CMOS inverter 510 constituted with a p-channel type transistor 511 and an n-channel type transistor 512; a CMOS inverter 520 constituted with a p-channel type transistor 521 and an n-channel type transistor 522; a switch (n-channel type transistor) 530; a clocked inverter 540 constituted with a p-channel type transistor 541, a p-channel type transistor 542, an n-channel type transistor 543, and an n-channel type transistor 544; a CMOS inverter 550 constituted with a p-channel type transistor 551 and an n-channel type transistor 552; a NAND circuit 560; a NOR circuit 570; an inverter 580; and an inverter 590.

As can be seen from FIG. 1 and FIG. 8, to each of the unit circuits 31, one of the binary clock signal BCK and the binary clock signal BCKB is input as a clock CK, the other of the binary clock signal BCK and the binary clock signal BCKB is input as a clock CKB, the output signal LIEN from the unit circuit 31 at one stage before is given as a set signal S, and the output signal LIEN from the unit circuit 31 at one stage later is given as a reset signal R. However, the binary start pulse signal BSP is given as the set signal S to the unit circuit 31 (1) at the first stage.

In the unit circuit 31, in a case where the set signal S is set to the high level while the reset signal R is maintained at the low level, the potential of the node 515 is set to the low level while the switch 530 is off. As a result, the potential of the node 525 is set to the high level. Here, for the clocked inverter 540, the input terminal is connected to the node 546, and the output terminal is connected to the node 547. For the CMOS inverter 550, the input terminal is connected to the node 547, and the output terminal is connected to the node 546. In the configuration described above, during the period in which the reset signal R is maintained at the low level, the potential of the node 525 is held by the clocked inverter 540 and the CMOS inverter 550. In a case where the clock CK is at the high level in this state, the output signal from the NAND circuit 560 is set to the low level. At this time, the clock CKB is at the low level, and the output signal from the NOR circuit 570 is at the high level. Then, the output signal from the inverter 580 is set to the low level, and the output signal from the inverter 590 is set to the high level. In this way, the output signal OUT from the unit circuit 31 is set to the high level.

In the unit circuit 31, in a case where the reset signal R is set to the high level while the set signal S is maintained at the low level, the n-channel type transistors 522 and 530 are in the on state and the p-channel type transistor 521 is in the off state, so the potential of the node 525 is set to the low level. At this time, because the potential of the node 547 is also set to the low level, the output signal from the NAND circuit 560 is set to the high level regardless of whether the clock CK is at the high level or the low level. As a result, the output signal from the NOR circuit 570 is set to the low level regardless of whether the clock CKB is at the high level or the low level. Then, the output signal from the inverter 580 is set to the high level, and the output signal from the inverter 590 is set to the low level. In this way, the output signal OUT from the unit circuit 31 is set to the low level.

In the configuration described above, in each of the unit circuits 31, after the set signal S is set to the high level, the output signal LTEN is set to the high level, based on the clocks CK and CKB (i.e., the shift pulse is outputted). Then, the output signal LTEN is set to the low level by the reset signal R being at the high level.

Since the unit circuit 31 operates as described above, the output signal LTEN from the unit circuit 31 is set to the high level stage by stage, based on the binary clock signals BCK and BCKB, after the generation of the pulse of the binary start pulse signal BSP. That is, the high-level output signal LTEN output from each of the unit circuits 31 is sequentially transferred as a shift pulse from the first stage to the final stage. The output signal LTEN from each of the unit circuits 31 is provided to the unit circuits 31 at the next stage and the previous stage, is provided as a first latch signal to the corresponding first latch circuit 32, and is provided as a second latch signal to the second latch circuit 33 in two prior stages. In this way, the first latch circuit 32 as well as the second latch circuit 33 are operated based on the output signal LTEN from the unit circuit 31 constituting the shift register 310.

With respect to the constituent elements illustrated in FIG. 1, each of the first latch circuits 32 captures the data signal DATA transmitted from the outside, based on the first latch signal (output signal LTEN from the corresponding unit circuit 31) and outputs the captured data signal. Each of the second latch circuits 33 captures the data signal output from the corresponding first latch circuit 32, based on the second latch signal (output signal LTEN from the unit circuit 31 of two stages later), and outputs the captured data signal to the corresponding source bus line SL.

Figure 7:
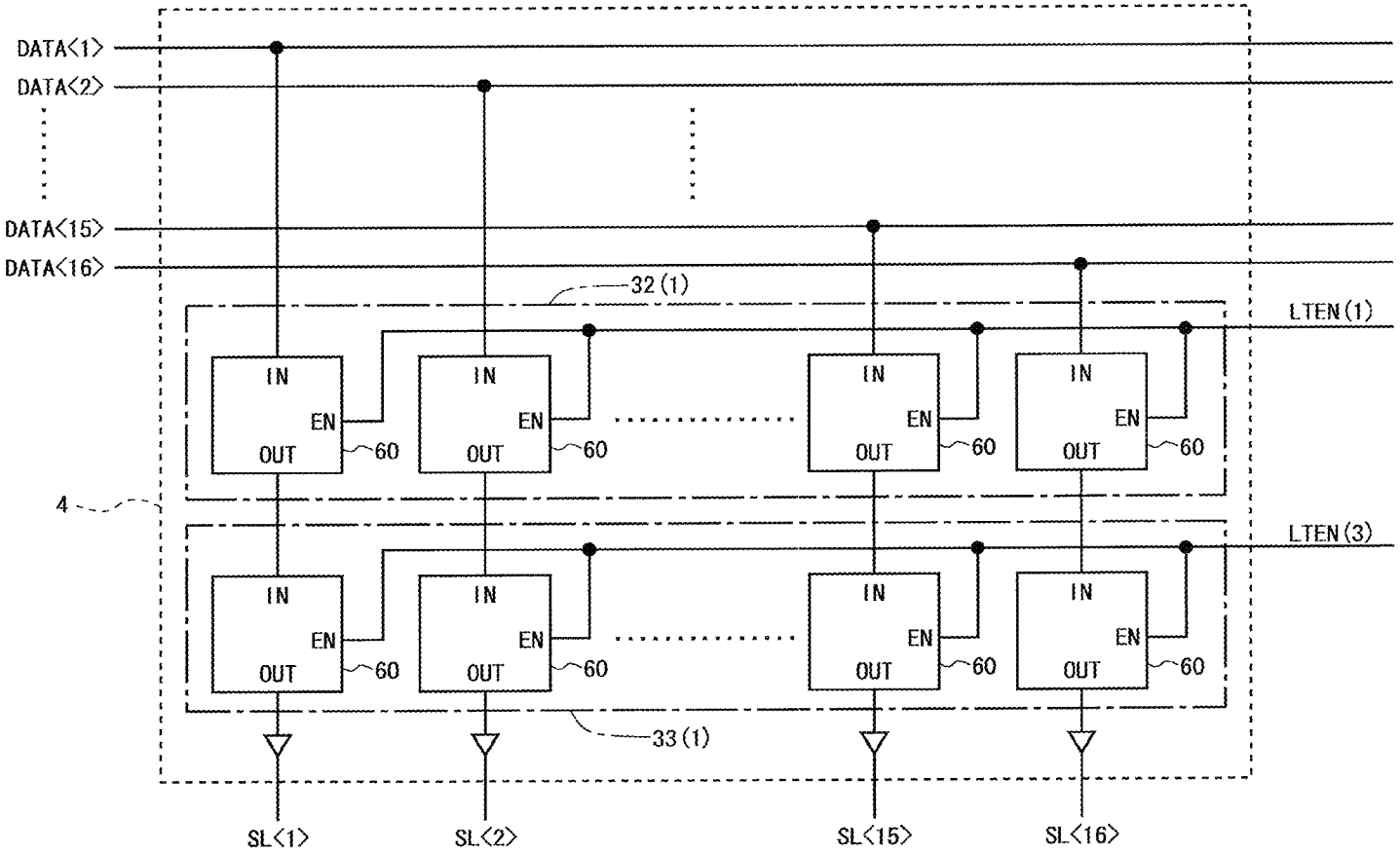
FIG. 7 is a circuit block diagram for describing a configuration of one stage of the binary driver according to the first embodiment.

Incidentally, the portion denoted by reference sign 4 in FIG. 1 is actually configured as illustrated in FIG. 7. That is, each of the first latch circuits 32 includes 16 unit latch circuits 60 corresponding to each of the 16 source bus lines SL. Similarly, each of the second latch circuits 33 includes 16 unit latch circuits 60 corresponding to each of the 16 source bus lines SL. The unit latch circuits employ D latch circuits, referred to as "pass-through latches", "gated D latches" and the like.

Figure 9:
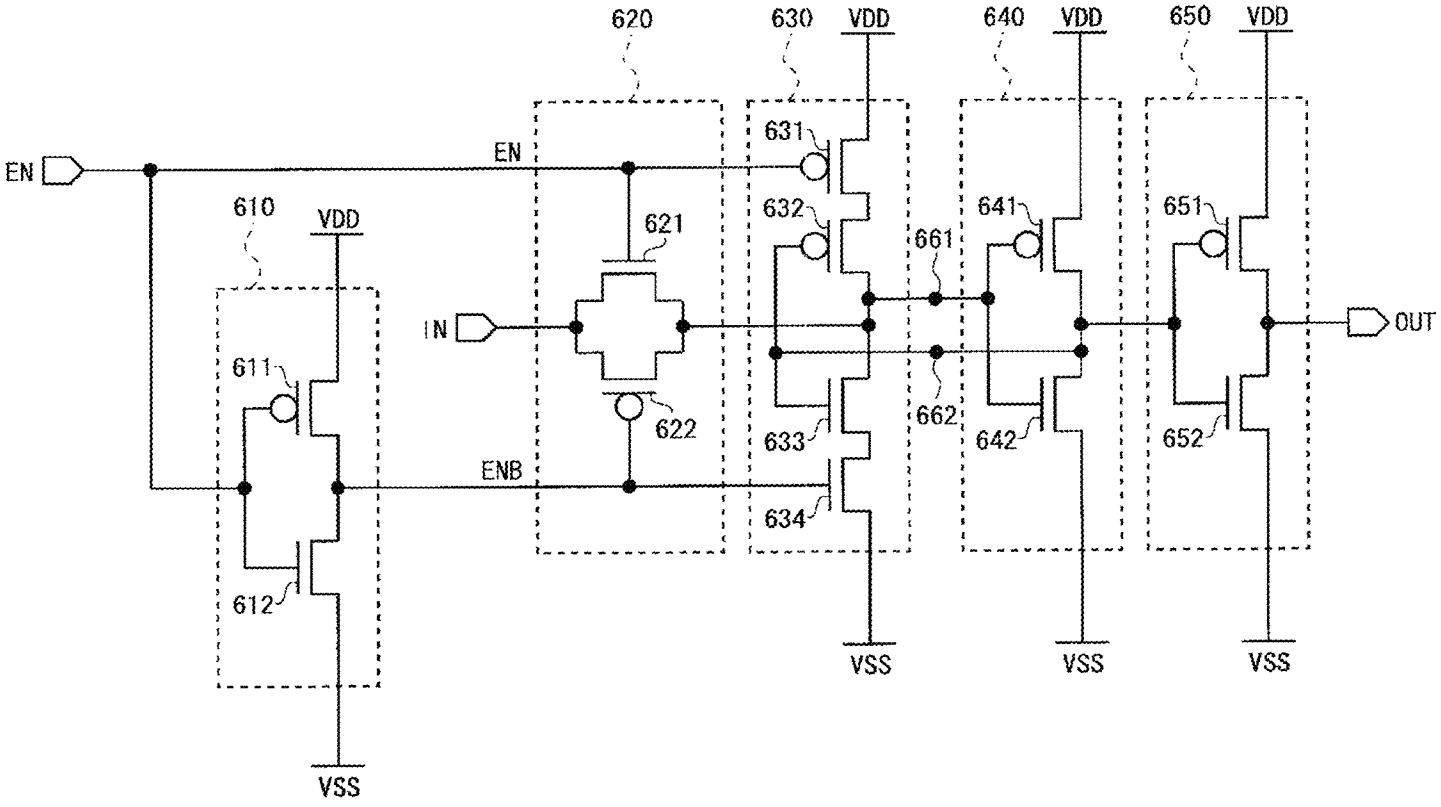
FIG. 9 is a circuit diagram illustrating a detailed configuration of a unit latch circuit according to the first embodiment.

FIG. 9 is a circuit diagram illustrating a detailed configuration of a unit latch circuit 60. Note that the configuration described hereinafter is merely an example, and no such limitation is intended. The unit latch circuit 60 includes: a CMOS inverter 610 constituted with a p-channel type transistor 611 and an n-channel type transistor 612; a CMOS switch 620 constituted with an n-channel type transistor 621 and a p-channel type transistor 622; a clocked inverter 630 constituted with a p-channel type transistor 631, a p-channel type transistor 632, a n-channel type transistor 633, and an n-channel type transistor 634; a CMOS inverter 640 constituted with a p-channel type transistor 641 and an re-channel type transistor 642; and a CMOS inverter 650 constituted with a p-channel type transistor 651 and an re-channel type transistor 652.

The unit latch circuit 60 in the first latch circuit 32 is provided with a data signal DATA transmitted from the outside as an input signal IN, and is provided with a first latch signal as an enable signal EN. The unit latch circuit 60 in the second latch circuit 33 is provided with a data signal output from the corresponding unit latch circuit 60 in the first latch circuit 32 as an input signal IN, and is provided with a second latch signal as an enable signal EN. Note that the input signal IN to the unit latch circuit 60 is one bit of data (i.e., binary data).

The enable signal EN input to the unit latch circuit 60 is provided to the gate terminal of the n-channel type transistor 621. As illustrated in FIG. 9, the CMOS inverter 610 is provided so that an inverted enable signal ENB is provided to the gate terminal of the p-channel type transistor 622. In the configuration described above, in a case where the enable signal EN is at the high level, both the n-channel type transistor 621 and the p-channel type transistor 622 are set to the on state, so the input signal IN is provided to the clocked inverter 630. On the other hand, in a case where the enable signal EN is at the low level, both the n-channel type transistor 621 and the p-channel type transistor 622 are set to the off state, so the input signal IN is not provided to the clocked inverter 630.

For the clocked inverter 630, the input terminal is connected to the node 662, and the output terminal is connected to the node 661. For the CMOS inverter 640, the input terminal is connected to the node 661, and the output terminal is connected to the node 662. In a case where the enable signal EN is at the low level, both the p-channel type transistor 631 and the n-channel type transistor 634 are set to the on state, and in a case where the enable signal EN is at the high level, both the p-channel type transistor 631 and the n-channel type transistor 634 are set to the off state. In the configuration described above, the value of the input signal IN input to the unit latch circuit 60 in a case where the enable signal EN is at the high level is then held by the clocked inverter 630 and the CMOS inverter 640 over a period until the next time the enable signal EN is set to the high level. Incidentally, in a case where the input signal IN is at the high level, the potential of the node 661 is set to the high level, and the output signal OUT is also set to the high level. On the other hand, in a case where the input signal IN is at the low level, the potential of the node 661 is set to the low level, and the output signal OUT is also set to the low level.

Because the unit latch circuit 60 operates as described above, the first latch circuit 32 captures and outputs the data signal, based on the first latch signal, and the second latch circuit 33 captures and outputs the data signal, based on the second latch signal.

1.4 Operation of Binary Driver

Figure 10:
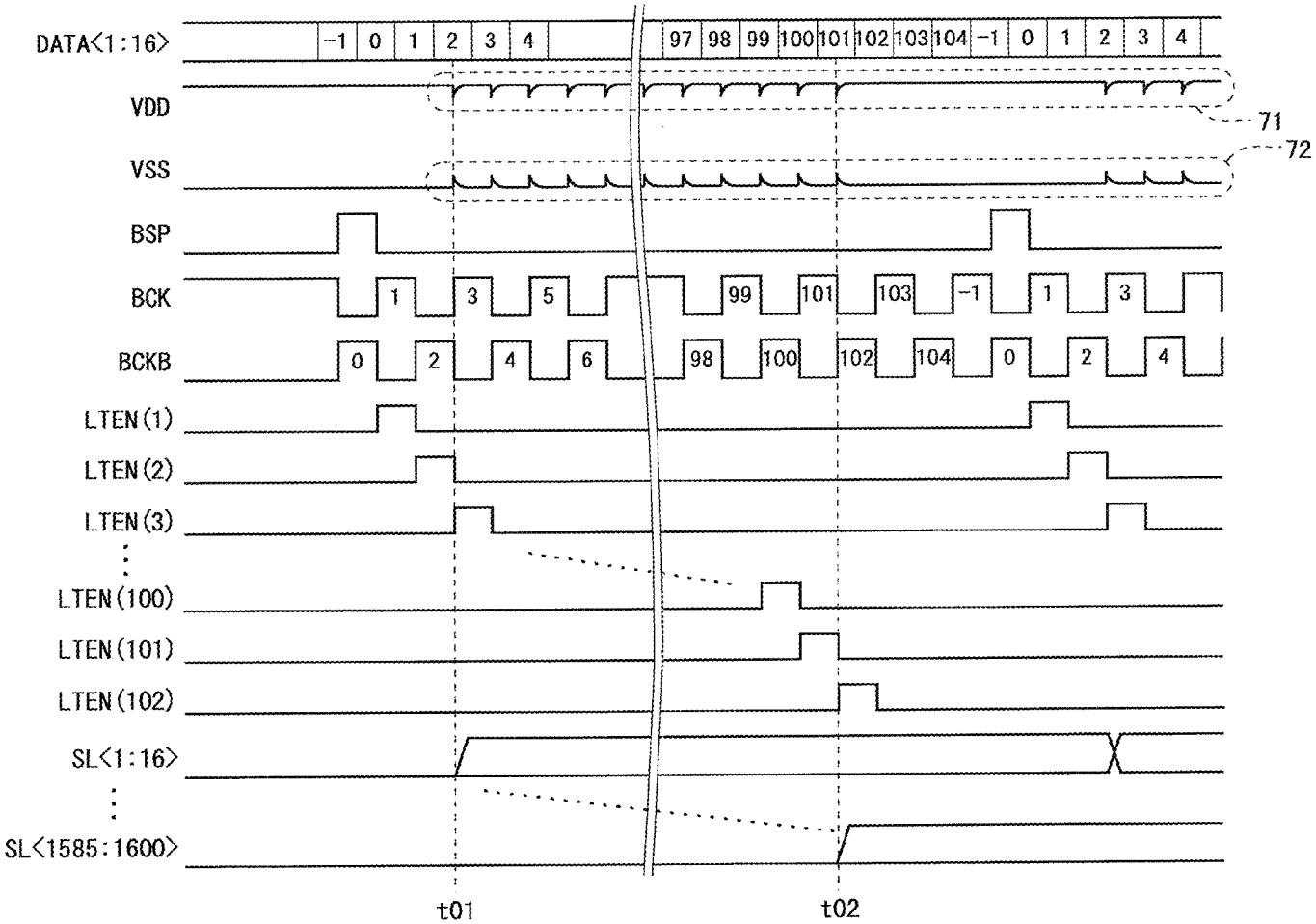
FIG. 10 is a signal waveform diagram for describing the operation of the binary driver according to the first embodiment.
Figure 11:
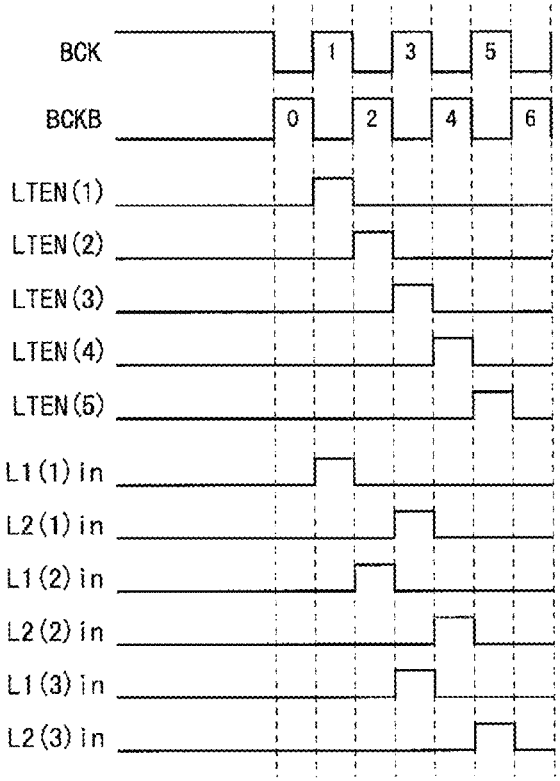
FIG. 11 is a signal waveform diagram for describing the first latch signal provided to the first latch circuit and the second latch signal provided to the second latch circuit according to the first embodiment.
Figure 12:
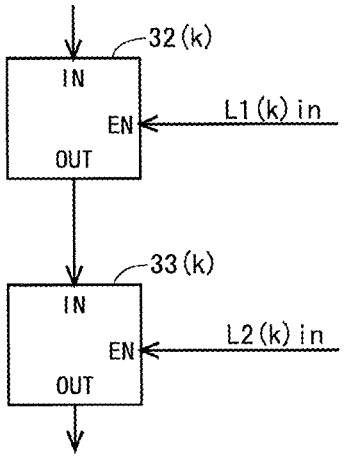
FIG. 12 is a diagram for describing reference signs used in FIG. 11.

FIG. 10 is a signal waveform diagram for describing the operation of the binary driver 30 according to the present embodiment. FIG. 11 is a signal waveform diagram for describing the first latch signal provided to the first latch circuit 32 and the second latch signal provided to the second latch circuit 33. FIG. 12 is a diagram for describing reference signs used in FIG. 11. As illustrated in FIG. 12, in FIG. 11, the first latch signal provided to the first latch circuit 32 (*k*) at the k stage is denoted by the reference sign L1 (*k*) in, and the second latch signal provided to the second latch circuit 33 (*k*) at the k stage is denoted by the reference sign L2 (*k*) in (the same applies to FIG. 15, FIG. 18, FIG. 21, and FIG. 25).

After the pulse generation of the binary start pulse signal BSP, in a case where the binary clock signal BCK rises first, the output signal LIEN (1) from the unit circuit 31 (1) at the first stage is set to the high level. The output signal LIEN (1) is provided to the first latch circuit 32 (1) at the first stage as the first latch signal L1 (1) in. As a result, the first latch circuit 32 (1) at the first stage captures the data signal DATA transmitted from the outside. Next, in a case where the binary clock signal BCKB rises, the output signal LIEN (2) from the unit circuit 31 (2) at the second stage is set to the high level. The output signal LIEN (2) is provided to the first latch circuit 32 (2) at the second stage as the first latch signal L1 (2) in. As a result, the first latch circuit 32 (2) at the second stage captures the data signal DATA transmitted from the outside. Next, in a case where the binary clock signal BCK rises, the output signal LIEN (3) from the unit circuit 31 (3) at the third stage is set to the high level. The output signal LIEN (3) is provided to the first latch circuit 32 (3) at the third stage as the first latch signal L1 (3) in. As a result, the first latch circuit 32 (3) at the third stage captures the data signal DATA transmitted from the outside.

Incidentally, the output signal LIEN (3) is provided as the second latch signal L2 (1) in to the second latch circuit 33 (1) at the first stage. Thus, at the time point t01 (see FIG. 10), the second latch circuit 33 (1) at the first stage captures the data signal output from the first latch circuit 32 (1) at the first stage. Then, the data signal captured in the second latch circuit 33 (1) at the first stage is output to the 1 to 16 column source bus lines. Thereafter, each time the binary clock signal BCK or the binary clock signal BCKB rises, the capturing of the data signal in the first latch circuit 32 and the capturing of the data signal in the second latch circuit 33 are performed. Note that in a case where the output signal LIEN (N) from the unit circuit 31 (N) at the N-th stage is set to the high level as N is an integer equal to or greater than 3, the first latch signal L1 (N) in provided to the first latch circuit 32 (N) at the N-th stage and the second latch signal L2 (N−2) in provided to the second latch circuit 33 (N−2) at the (N−2)-th stage are set to the high level, and the data signal DATA transmitted from the outside is captured by the first latch circuit 32 (N) at the N-th stage, while the data signal output from the first latch circuit 32 (N−2) at the (N−2)-th stage is capture by the second latch circuit 33 (N−2) at the (N−2)-th stage (see FIG. 11).

At the time point t02 (see FIG. 10), the output signal LIEN (102) from the unit circuit 31 (102) at the 102-th stage is set to the high level, and the data signal output from the first latch circuit 32 (100) at the 100-th stage is captured by the second latch circuit 33 (100) at the 100-th stage. The data signal captured in the second latch circuit 33 (100) at the 100-th stage is output to the 1585 to 1600 column source bus lines.

1.5 Effect

According to the present embodiment, as k is a natural number, the second latch circuit 33 (*k*) at the k-th stage is given the output signal LIEN (k+2) from the unit circuit 31 (k+2) at the (k+2)-th stage (in other words, the first latch signal provided to the first latch circuit 32 (k+2) at the (k+2)-th stage) as the second latch signal. For this reason, the capturing of the data signal in the second latch portion 330 is not performed in unison, but is performed sequentially stage by stage. In other words, the output of the data signal to the source bus lines is performed sequentially for every 16 lines. Since the output timing of the data signal to the source bus lines is distributed in this manner, the size of the voltage drop caused by the output of the data signal to the source bus lines becomes significantly smaller than in the related art (see portions with the reference signs 71 and 72 in FIG. 10). Unlike the technique disclosed in JP 2010-122509 A, the time difference of the capturing timing of the data signal can be increased without increasing the circuit size. As described above, according to the present embodiment, a binary driver 30 can be realized in which a voltage drop effect can be effectively reduced while suppressing an increase in circuit size.

2. Second Embodiment

Hereinafter, aspects different from the first embodiment will be mainly described.

2.1 Configuration of Binary Driver

Figure 13:
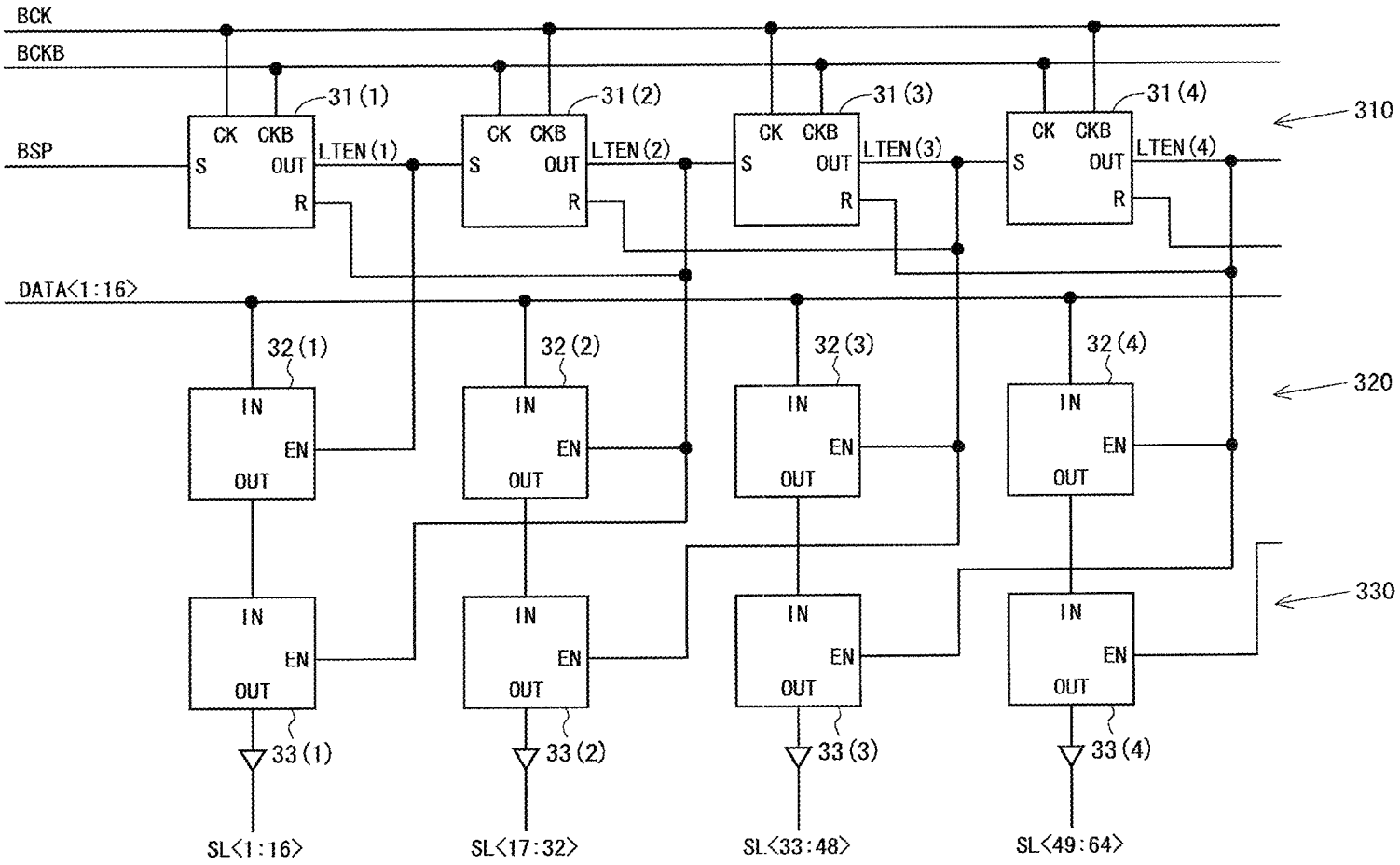
FIG. 13 is a circuit block diagram illustrating a configuration of a portion of a binary driver according to a second embodiment.

FIG. 13 is a circuit block diagram illustrating a configuration of a portion of the binary driver 30 according to the present embodiment. In the present embodiment, as k is a natural number, the second latch circuit 33 (*k*) at the k-th stage is provided with the first latch signal provided to the first latch circuit 32 (k+1) at the (k+1)-th stage as the second latch signal. In other words, the second latch circuit 33 (*k*) at the k-th stage is provided with the output signal LIEN (k+1) from the unit circuit 31 (k+1) at the (k+1)-th stage as the second latch signal. For example, the second latch circuit 33 (3) at the third stage is provided with the output signal LIEN (4) from the unit circuit 31 (4) at the fourth stage as the second latch signal.

2.2 Operation of Binary Driver

Figure 14:
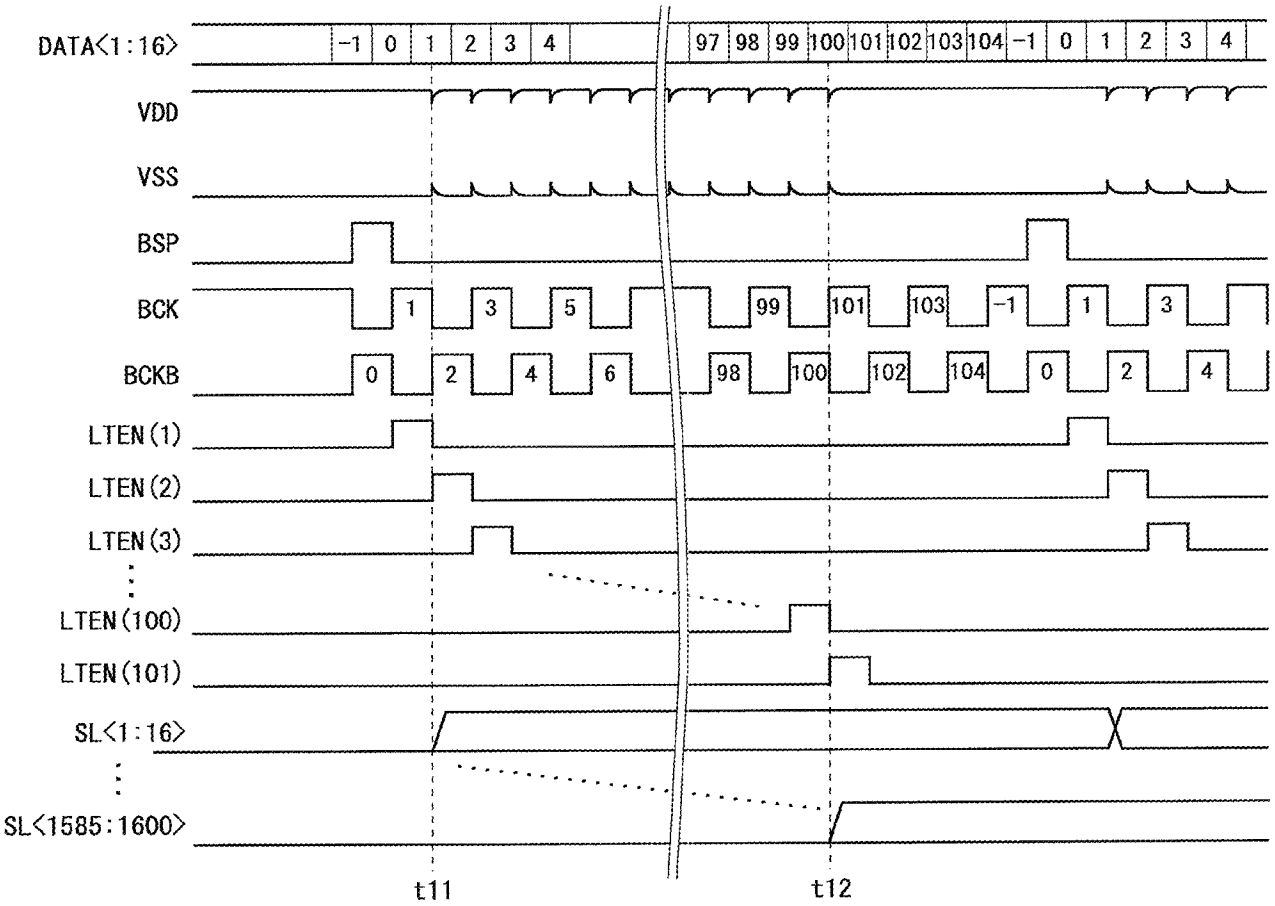
FIG. 14 is a signal waveform diagram for describing the operation of the binary driver according to the second embodiment.
Figure 15:
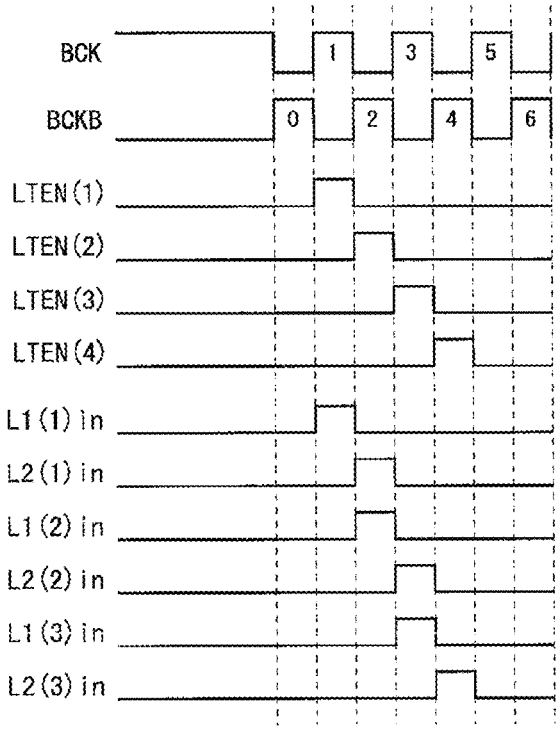
FIG. 15 is a signal waveform diagram for describing the first latch signal provided to the first latch circuit and the second latch signal provided to the second latch circuit according to the second embodiment.

FIG. 14 is a signal waveform diagram for describing the operation of the binary driver 30 according to the present embodiment. FIG. 15 is a signal waveform diagram for describing the first latch signal provided to the first latch circuit 32 and the second latch signal provided to the second latch circuit 33.

After the pulse of the binary start pulse signal BSP is generated, in a case where the binary clock signal BCK rises first, the output signal LIEN (1) is set to the high level, and as in the first embodiment, the data signal DATA transmitted from the outside is captured by the first latch circuit 32 (1) at the first stage. Next, in a case where the binary clock signal BCKB rises, the output signal LIEN (2) is set to the high level, and as in the first embodiment, the data signal DATA transmitted from the outside is captured by the first latch circuit 32 (2) at the second stage.

In the present embodiment, the output signal LIEN (2) is provided as the second latch signal L2 (1) in to the second latch circuit 33 (1) at the first stage (see FIG. 15). Thus, at the time point t11 (see FIG. 14), the second latch circuit 33 (1) at the first stage captures the data signal output from the first latch circuit 32 (1) at the first stage. Then, the data signal captured in the second latch circuit 33 (1) at the first stage is output to the 1 to 16 column source bus lines. Thereafter, each time the binary clock signal BCK or the binary clock signal BCKB rises, the capturing of the data signal in the first latch circuit 32 and the capturing of the data signal in the second latch circuit 33 are performed. Note that in a case where the output signal LIEN (N) from the unit circuit 31 (N) at the N-th stage is set to the high level as N is an integer equal to or greater than 2, the first latch signal L1 (N) in provided to the first latch circuit 32 (N) at the N-th stage and the second latch signal L2 (N−1) in provided to the second latch circuit 33 (N−1) at the (N−1)-th stage are set to the high level, and the data signal DATA transmitted from the outside is captured by the first latch circuit 32 (N) at the N-th stage, while the data signal output from the first latch circuit 32 (N−1) at the (N−1)-th stage is capture by the second latch circuit 33 (N−1) at the (N−1)-th stage (see FIG. 15).

At the time point t12 (see FIG. 14), the output signal LIEN (101) from the unit circuit 31 (101) at the 101-th stage is set to the high level, and the data signal output from the first latch circuit 32 (100) at the 100-th stage is captured by the second latch circuit 33 (100) at the 100-th stage. The data signal captured in the second latch circuit 33 (100) at the 100-th stage is output to the 1585 to 1600 column source bus lines.

2.3 Effects

In the present embodiment as well, similar to the first embodiment, a binary driver 30 can be realized in which a voltage drop effect can be effectively reduced while suppressing an increase in circuit size.

3. Third Embodiment 3.1 Configuration of Binary Driver

Figure 16:
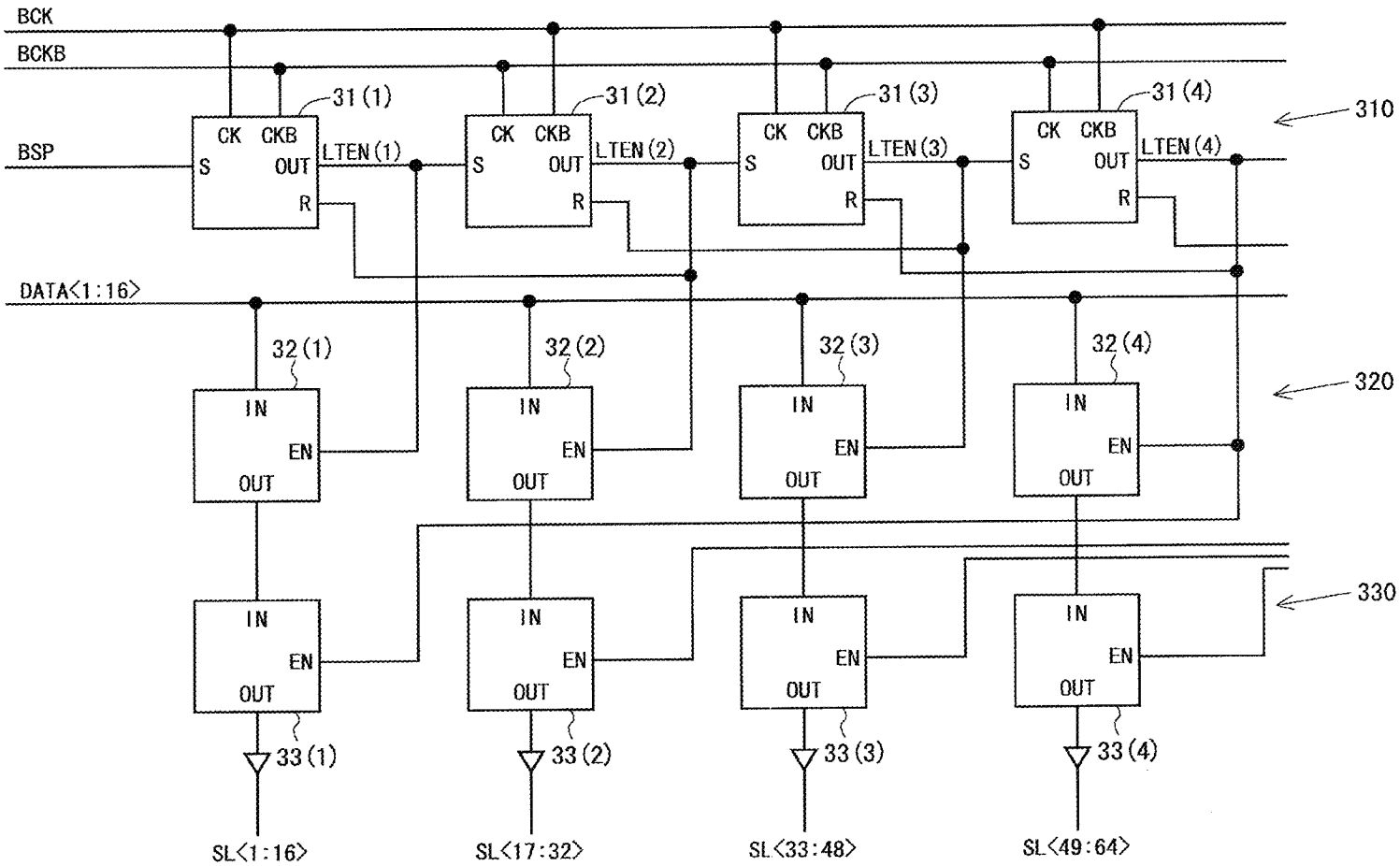
FIG. 16 is a circuit block diagram illustrating a configuration of a portion of a binary driver according to a third embodiment.

FIG. 16 is a circuit block diagram illustrating a configuration of a portion of the binary driver 30 according to the present embodiment. In the present embodiment, as k is a natural number, the second latch circuit 33 (*k*) at the k-th stage is provided with the first latch signal provided to the first latch circuit 32 (k+3) at the (k+3)-th stage as the second latch signal. In other words, the second latch circuit 33 (*k*) at the k-th stage is provided with the output signal LTEN (k+3) from the unit circuit 31 (k+3) at the (k+3)-th stage as the second latch signal. For example, the second latch circuit 33 (1) at the first stage is provided with the output signal LTEN (4) from the unit circuit 31 (4) at the fourth stage as the second latch signal. Note that the first latch signal provided to the first latch circuit 32 after the (k+4)-th stage may be provided as the second latch signal to the second latch circuit 33 (*k*) at the k-th stage.

3.2 Operation of Binary Driver

Figure 17:
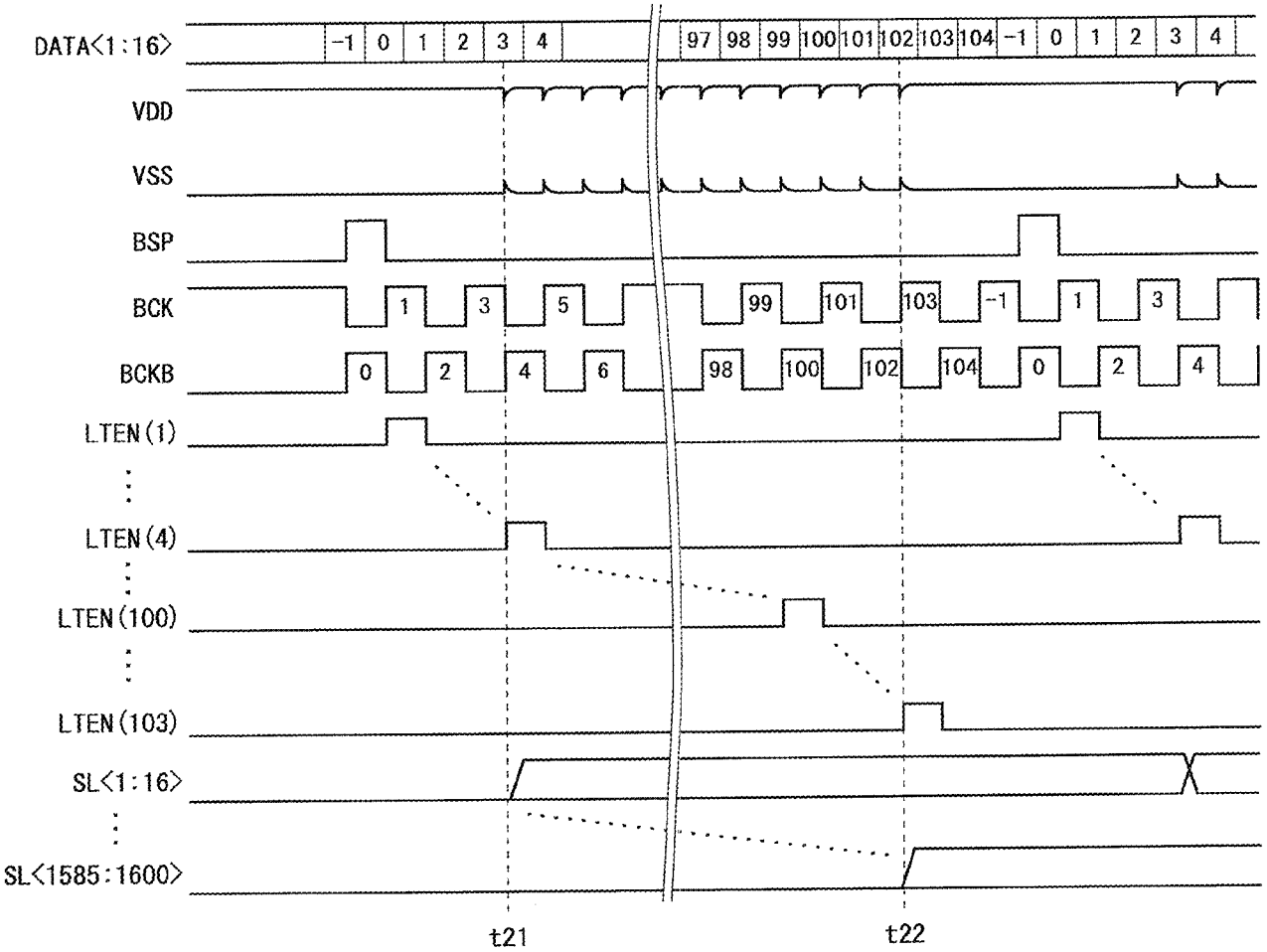
FIG. 17 is a signal waveform diagram for describing the operation of the binary driver according to the third embodiment.
Figure 18:
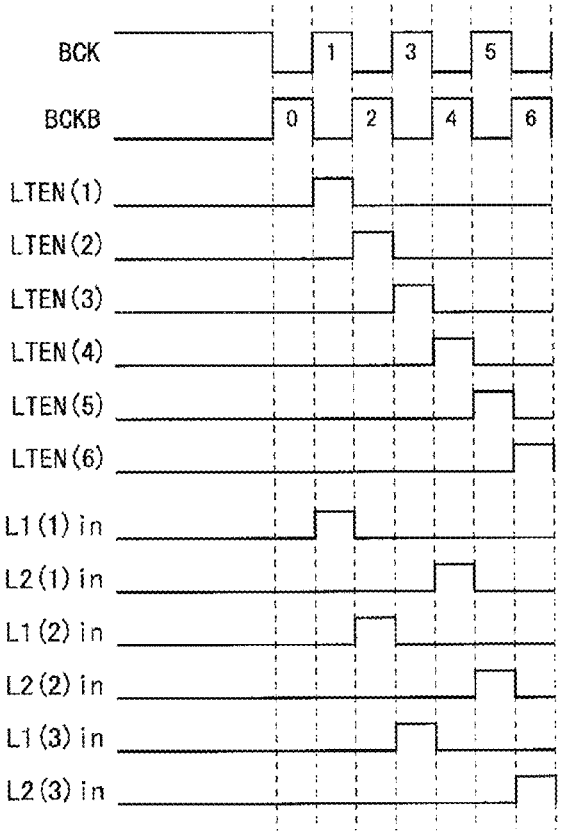
FIG. 18 is a signal waveform diagram for describing the first latch signal provided to the first latch circuit and the second latch signal provided to the second latch circuit according to the third embodiment.

FIG. 17 is a signal waveform diagram for describing the operation of the binary driver 30 according to the present embodiment. FIG. 18 is a signal waveform diagram for describing the first latch signal provided to the first latch circuit 32 and the second latch signal provided to the second latch circuit 33.

In the present embodiment, the second latch circuit 33 (1) at the first stage is provided with the output signal LIEN (4) from the unit circuit 31 (4) at the fourth stage as the second latch signal. Therefore, by the output signal LTEN (4) being set to the high level at the time point t21 (see FIG. 17), the data signal output from the first latch circuit 32 (1) at the first stage is captured in the second latch circuit 33 (1) at the first stage. Then, the data signal captured in the second latch circuit 33 (1) at the first stage is output to the 1 to 16 column source bus lines. Thereafter, each time the binary clock signal BCK or the binary clock signal BCKB rises, the capturing of the data signal in the first latch circuit 32 and the capturing of the data signal in the second latch circuit 33 are performed. Note that in a case where the output signal LTEN (N) from the unit circuit 31 (N) at the N-th stage is set to the high level as N is an integer equal to or greater than 4, the first latch signal L1 (N) in provided to the first latch circuit 32 (N) at the N-th stage and the second latch signal L2 (N−3) in provided to the second latch circuit 33 (N−3) at the (N−3)-th stage are set to the high level, and the data signal DATA transmitted from the outside is captured by the first latch circuit 32 (N) at the N-th stage, while the data signal output from the first latch circuit 32 (N−3) at the (N−3)-th stage is capture by the second latch circuit 33 (N−3) at the (N−3)-th stage (see FIG. 18).

At the time point t22 (see FIG. 17), the output signal LTEN (103) from the unit circuit 31 (103) at the 103-th stage is set to the high level, and the data signal output from the first latch circuit 32 (100) at the 100-th stage is captured by the second latch circuit 33 (100) at the 100-th stage. The data signal captured in the second latch circuit 33 (100) at the 100-th stage is output to the 1585 to 1600 column source bus lines.

3.3 Effects

In the present embodiment as well, similar to the first embodiment, a binary driver 30 can be realized in which a voltage drop effect can be effectively reduced while suppressing an increase in circuit size.

4. Fourth Embodiment 4.1 Configuration of Binary Driver

Figure 19:
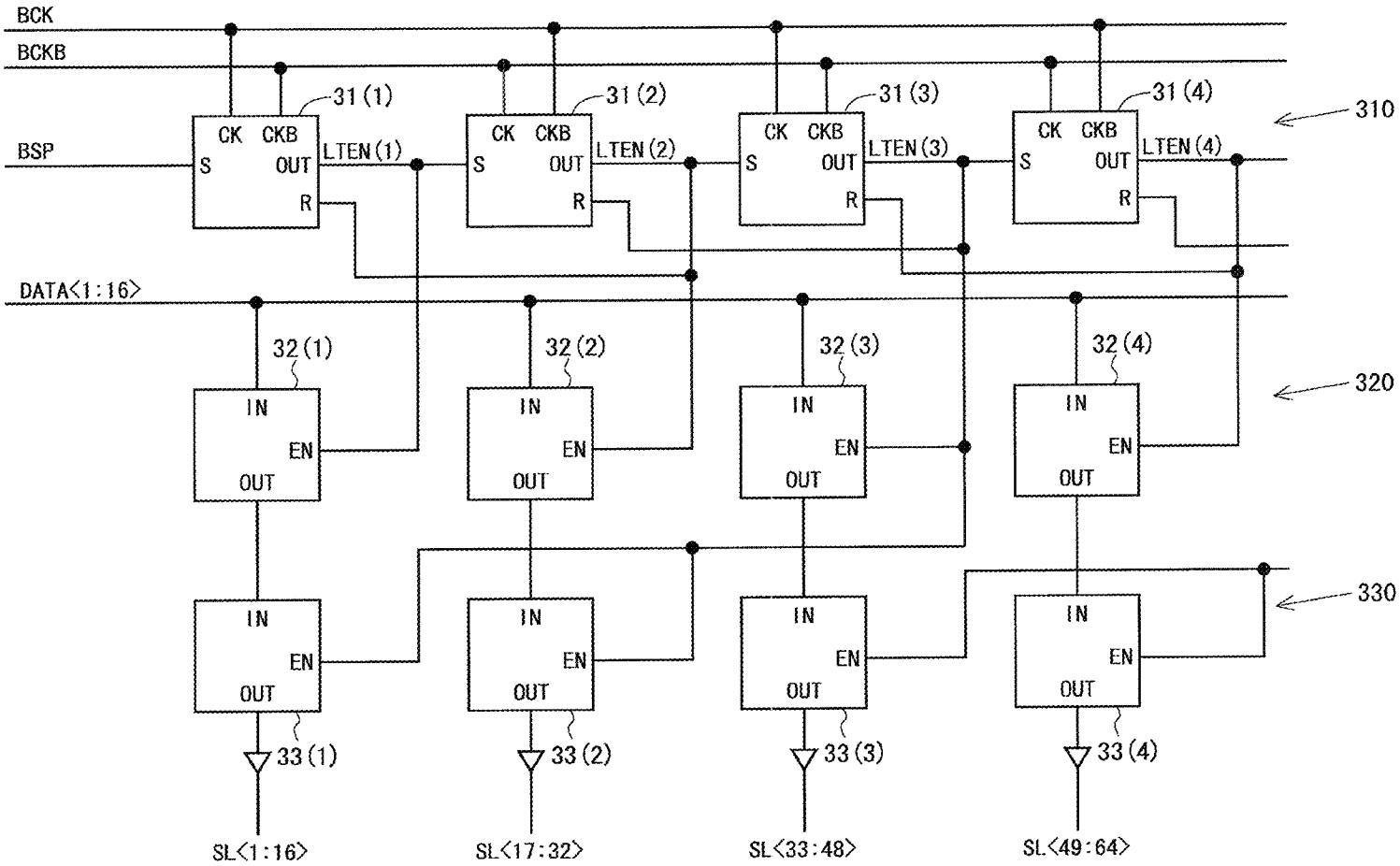
FIG. 19 is a circuit block diagram illustrating a configuration of a portion of a binary driver according to a fourth embodiment.

FIG. 19 is a circuit block diagram illustrating a configuration of a portion of the binary driver 30 according to the present embodiment. In the first to third embodiments, the output signal LIEN from each of the unit circuits 31 constituting the shift register 310 is provided only to one second latch circuit 33 as the second latch signal. In contrast, in the present embodiment, the output signals LIEN from the unit circuits 31 at the even-numbered stages are not provided to any second latch circuit 33 as the second latch signal, but the output signals LIEN from the unit circuits 31 at the odd-numbered stages are provided to two second latch circuits 33 that are continuous as the second latch signal. Specifically, as N is an odd number equal to or greater than 3, the output signal LIEN (N) from the unit circuit 31 (N) at the N-th stage is given to the second latch circuit 33 (N−2) at the (N−2)-th stage and the second latch circuit 33 (N−1) at the (N−1)-th stage as the second latch signal. For example, the output signal LIEN (3) from the unit circuit 31 (3) at the third stage is provided to the second latch circuit 33 (1) at the first stage and the second latch circuit 33 (2) at the second stage as the second latch signal. As described above, the two continuous second latch circuits 33 are given the same signal as the second latch signal.

4.2 Operation of Binary Driver

Figure 20:
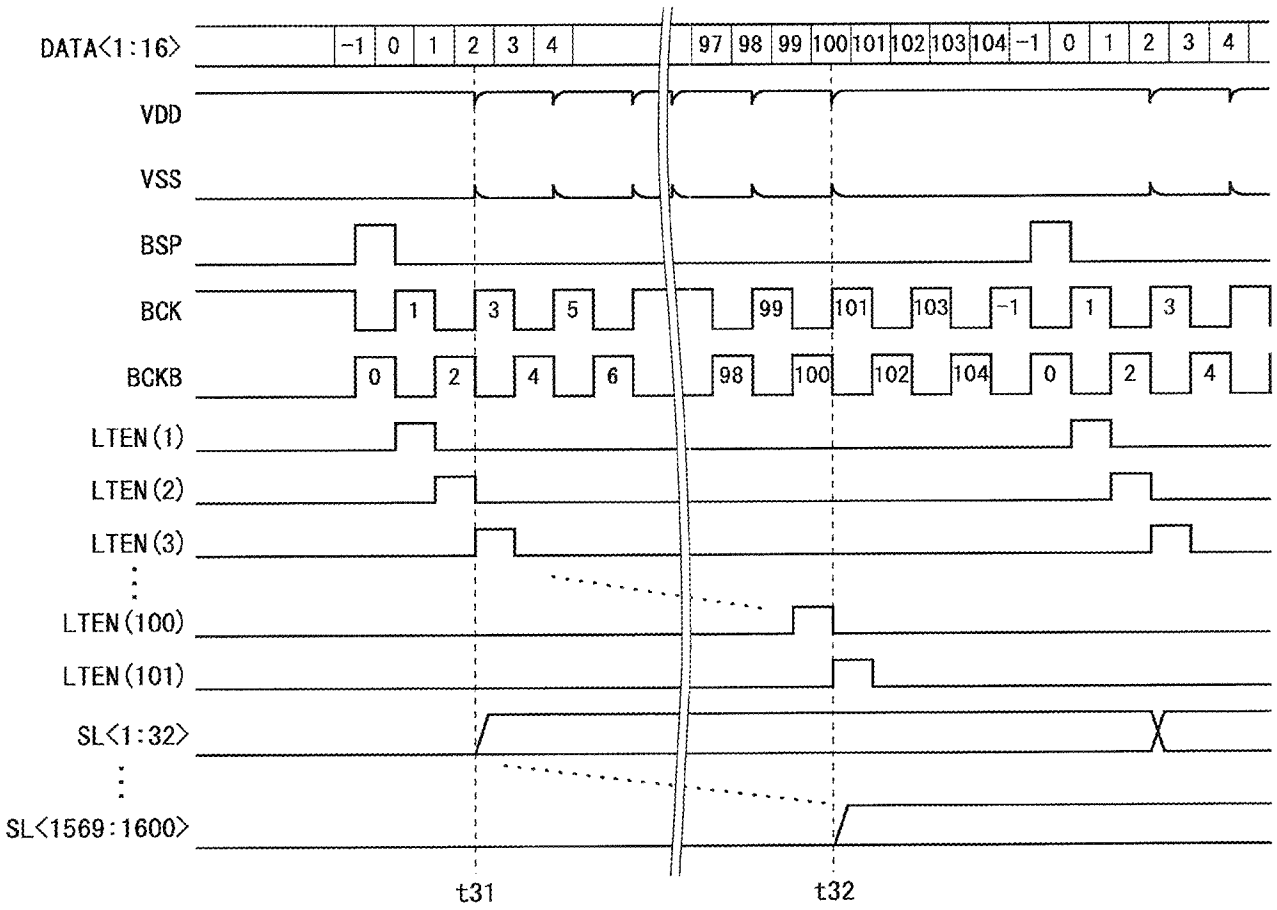
FIG. 20 is a signal waveform diagram for describing the operation of the binary driver according to the fourth embodiment.
Figure 21:
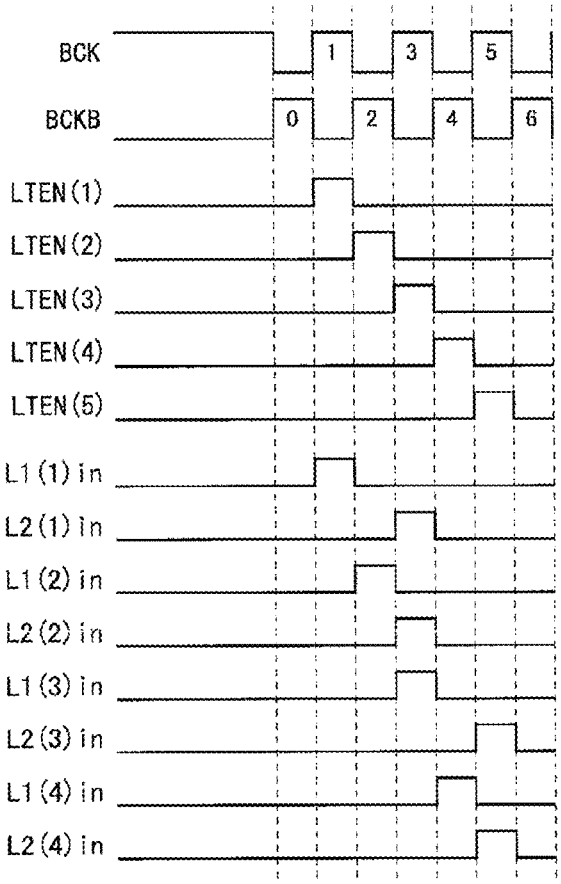
FIG. 21 is a signal waveform diagram for describing the first latch signal provided to the first latch circuit and the second latch signal provided to the second latch circuit according to the fourth embodiment.

FIG. 20 is a signal waveform diagram for describing the operation of the binary driver 30 according to the present embodiment. FIG. 21 is a signal waveform diagram for describing the first latch signal provided to the first latch circuit 32 and the second latch signal provided to the second latch circuit 33. Focusing on the second latch signal in FIG. 21, it is understood that the output signal LIEN (3) from the unit circuit 31 (3) at the third stage is provided as the second latch signals L2 (1) in to L2 (2) in to the second latch circuits 33 (1) to 33 (2) at the first to second stages, and it is understood that the output signal LIEN (5) from the unit circuit 31 (5) at the fifth stage is provided as the second latch signals L2 (3) in to L2 (4) in to the second latch circuits 33 (3) to 33 (4) at the third to fourth stages.

After the pulse of the binary start pulse signal BSP is generated, in a case where the binary clock signal BCK rises first, the output signal LIEN (1) is set to the high level, and as in the first embodiment, the data signal DATA transmitted from the outside is captured by the first latch circuit 32 (1) at the first stage. Next, in a case where the binary clock signal BCKB rises, the output signal LIEN (2) is set to the high level, and as in the first embodiment, the data signal DATA transmitted from the outside is captured by the first latch circuit 32 (2) at the second stage. Next, in a case where the binary clock signal BCK rises, the output signal LIEN (3) is set to the high level, and as in the first embodiment, the data signal DATA transmitted from the outside is captured by the first latch circuit 32 (3) at the third stage.

In the present embodiment, the output signal LIEN (3) is provided as the second latch signal L2 (1) in to the second latch circuit 33 (1) at the first stage and as the second latch signal L2 (2) in to the second latch circuit 33 (2) at the second stage. Thus, at the time point t31 (see FIG. 20), the data signal output from the first latch circuit 32 (1) at the first stage is captured by the second latch circuit 33 (1) at the first stage, and the data signal output from the first latch circuit 32 (2) at the second stage is captured by the second latch circuit 33 (2) at the second stage. Then, the data signal captured by the second latch circuit 33 (1) at the first stage and the second latch circuit 33 (2) at the second stage is output to the 1 to 32 column source bus lines. Thereafter, each time the binary clock signal BCK or the binary clock signal BCKB rises, the data signal is captured in the first latch circuit 32, and each time the binary clock signal BCK rises, the data signal is captured in the two second latch circuits 33. Note that, as N is an odd number equal to or greater than 3, in a case where the output signal LIEN (N) from the unit circuit 31 (N) at the N-th stage is set to the high level, in addition to the first latch signal L1 (N) in provided to the first latch circuit 32 (N) at the N-th stage being set to the high level, the second latch signal L2 (N−2) in provided to the second latch circuit 33 (N−2) at the (N−2)-th stage and the second latch signal L2 (N−1) in provided to the second latch circuit 33 (N−1) at the (N−1)-th stage are set to the high level (see FIG. 21). Accordingly, in a case where the output signal LIEN (N) is set to the high level, the capturing of the data signal output from the first latch circuit 32 is performed by the second latch circuit 33 (N−2) at the (N−2)-th stage and the second latch circuits 33 (N−1) at the stage (N−1).

At the time point t32 (see FIG. 20), the output signal LIEN (101) from the unit circuit 31 (101) at the 101-th stage is set to the high level, the data signal output from the first latch circuit 32 (99) at the 99-th stage is captured by the second latch circuit 33 (99) at the 99-th stage, and the data signal output from the first latch circuit 32 (100) at the 100-th stage is captured by the second latch circuit 33 (100) at the 100-th stage. The data signal captured by the first latch circuit 32 (99) at the 99-th stage and the second latch circuit 33 (100) at the 100-th stage are output to the 1569 to 1600 column source bus lines.

4.3 Effects

In the present embodiment as well, similar to the first embodiment, a binary driver 30 can be realized in which a voltage drop effect can be effectively reduced while suppressing an increase in circuit size.

5. Fifth Embodiment

5.1 Configuration of Binary Driver

Figure 22:
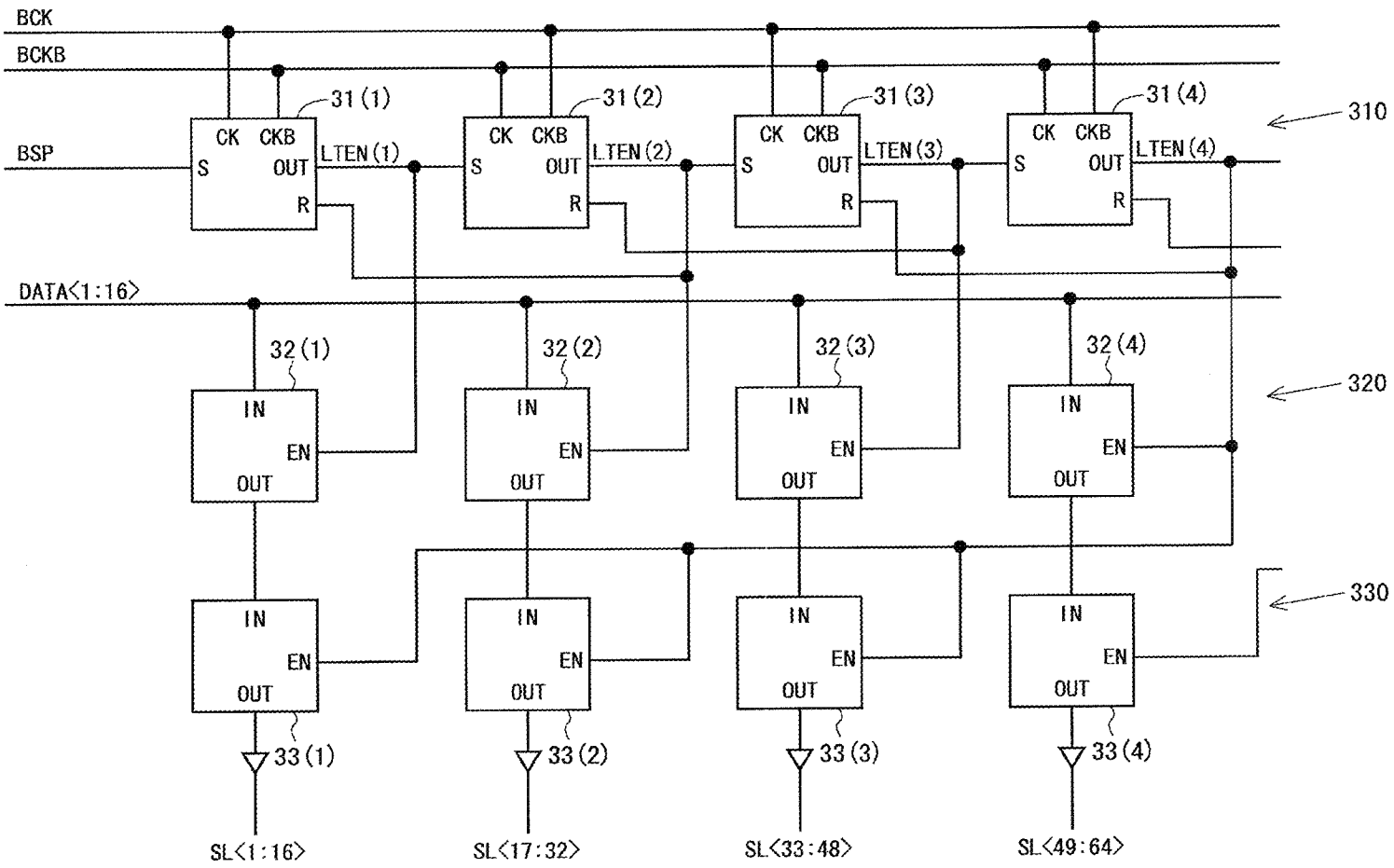
FIG. 22 is a circuit block diagram illustrating a configuration of a portion of a binary driver according to a fifth embodiment.

FIG. 22 is a circuit block diagram illustrating a configuration of a portion of the binary driver 30 according to the present embodiment. In the fourth embodiment, the same signal is provided as the second latch signal to two continuous second latch circuits 33 (see FIG. 19). In contrast, in the present embodiment, the same signal is provided as the second latch signal to three continuous second latch circuits 33. For example, the second latch circuits 33 (1) to 33 (3) at the first to third stages are provided with the output signal LIEN (4) from the unit circuit 31 (4) at the fourth stage as the second latch signal. Note that the same signal may be provided as the second latch signal to four or more continuous second latch circuits 33.

Figure 23:
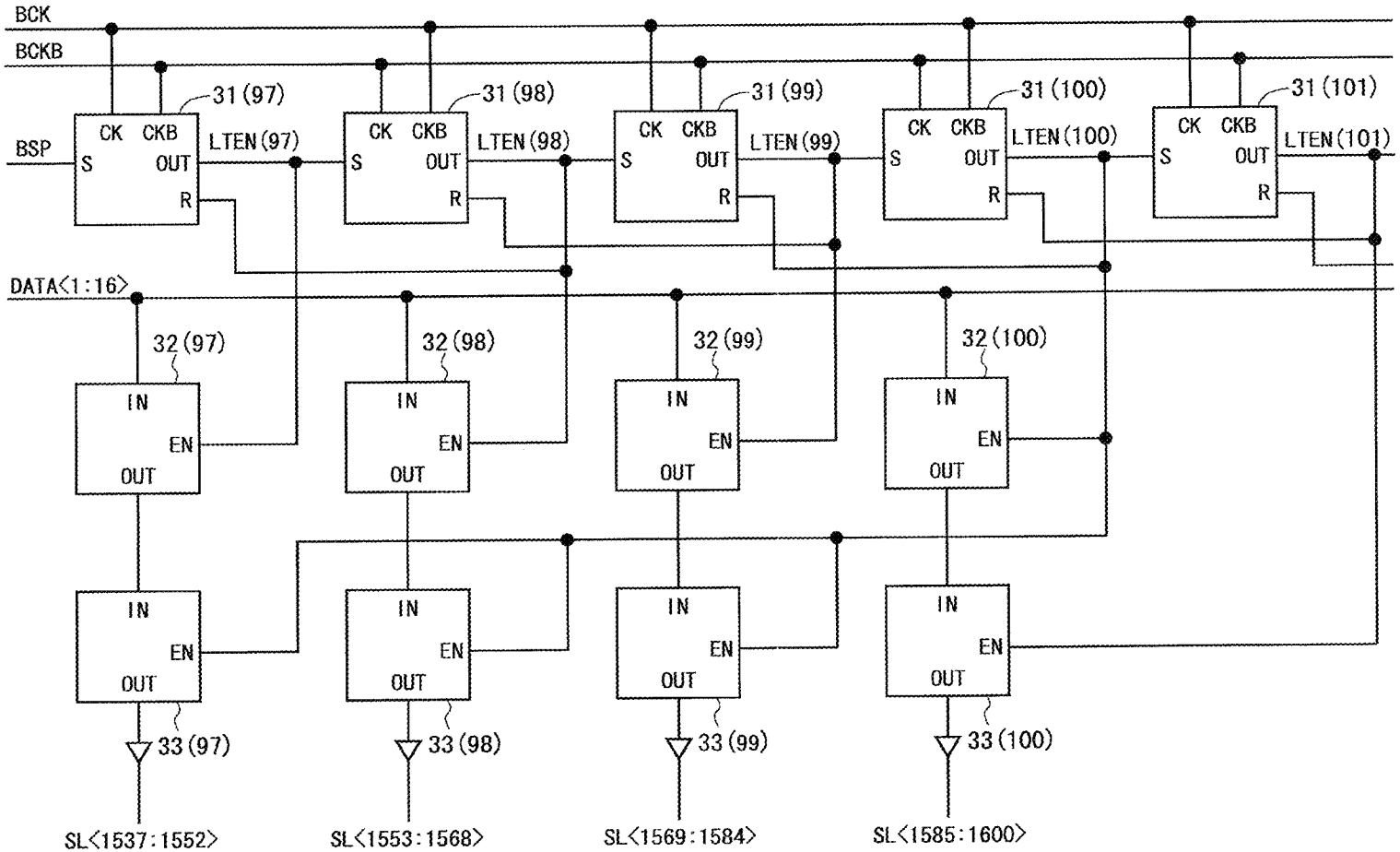
FIG. 23 is a circuit block diagram illustrating a configuration of a portion (final stage side) of the binary driver according to the fifth embodiment.

Incidentally, in the present embodiment, the grouping is performed for every three second latch circuits 33 in a configuration in which 100 second latch circuits 33 are present, the second latch circuit 33 (100) at the 100-th stage is not grouped. In other words, as illustrated in FIG. 23, the output signal LIEN (101) provided as the second latch signal to the second latch circuit 33 (100) at the 100-th stage is not provided as the second latch signal to the second latch circuits 33 other than that at the 100-th stage.

5.2 Operation of Binary Driver

Figure 24:
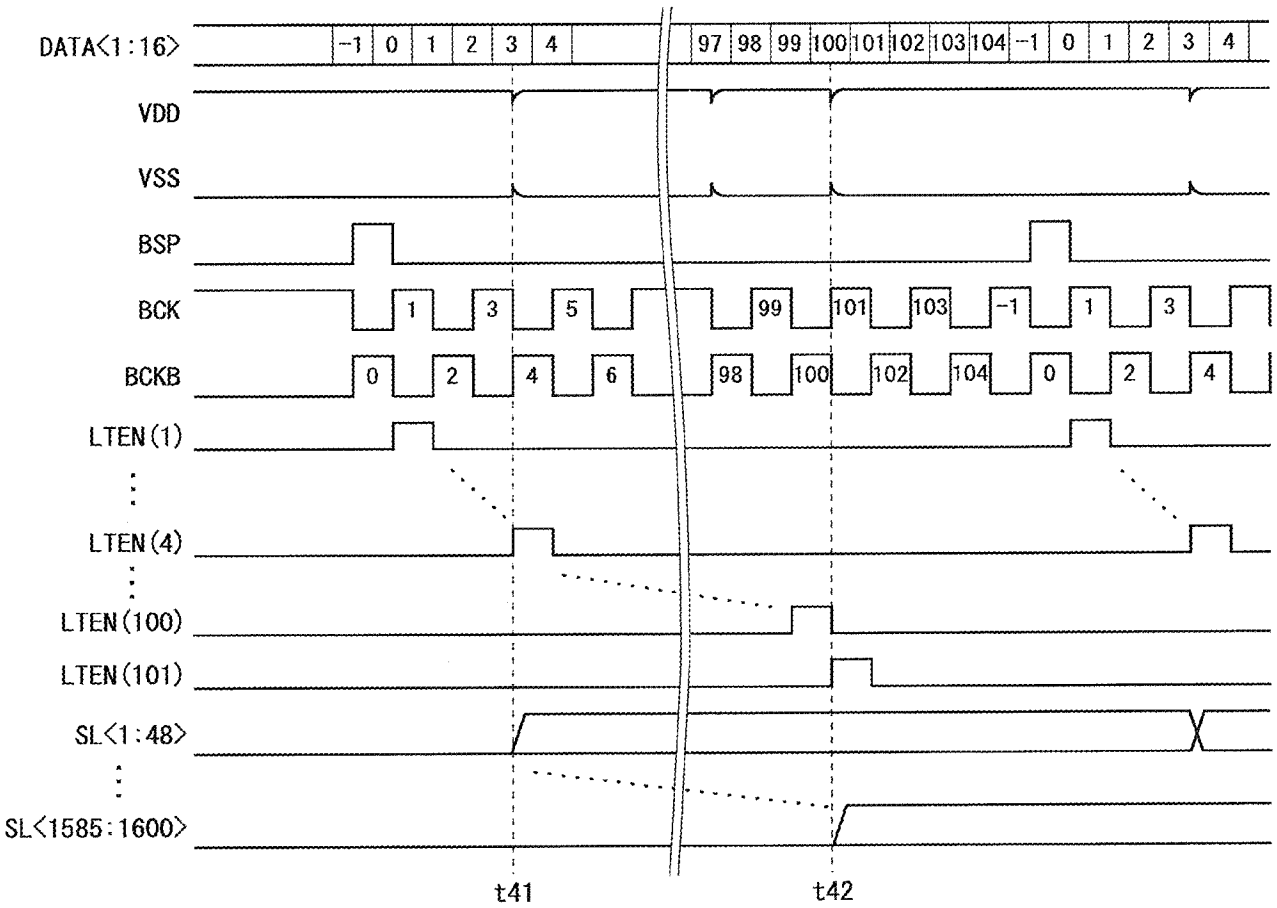
FIG. 24 is a signal waveform diagram for describing the operation of the binary driver according to the fifth embodiment.
Figure 25:
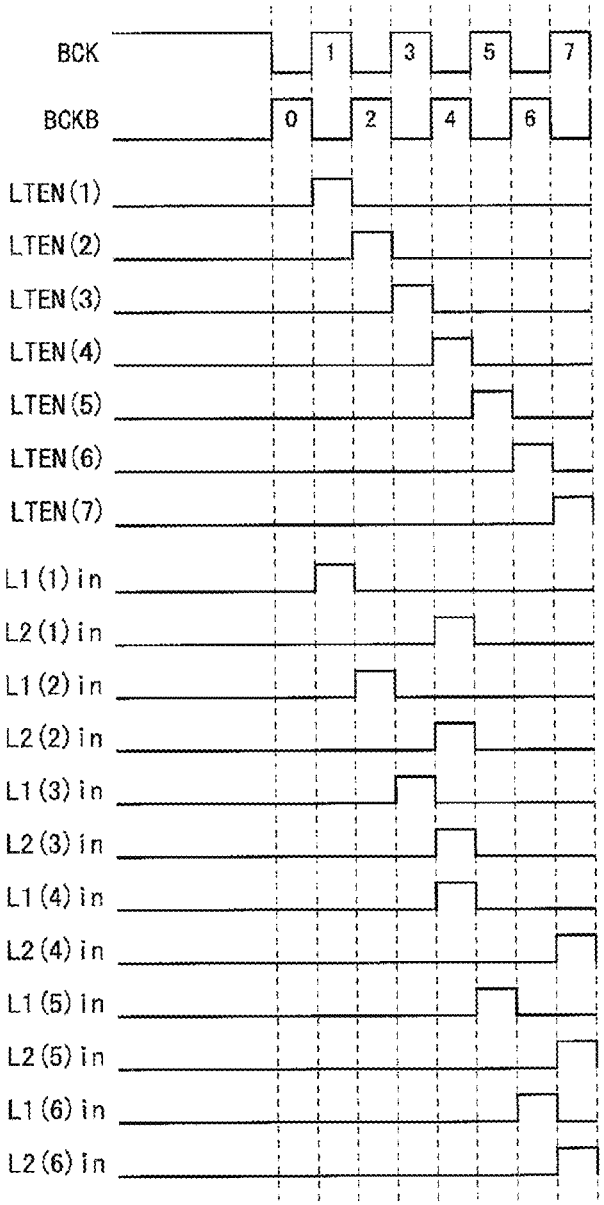
FIG. 25 is a signal waveform diagram for describing the first latch signal provided to the first latch circuit and the second latch signal provided to the second latch circuit according to the fifth embodiment.
Figure 26:
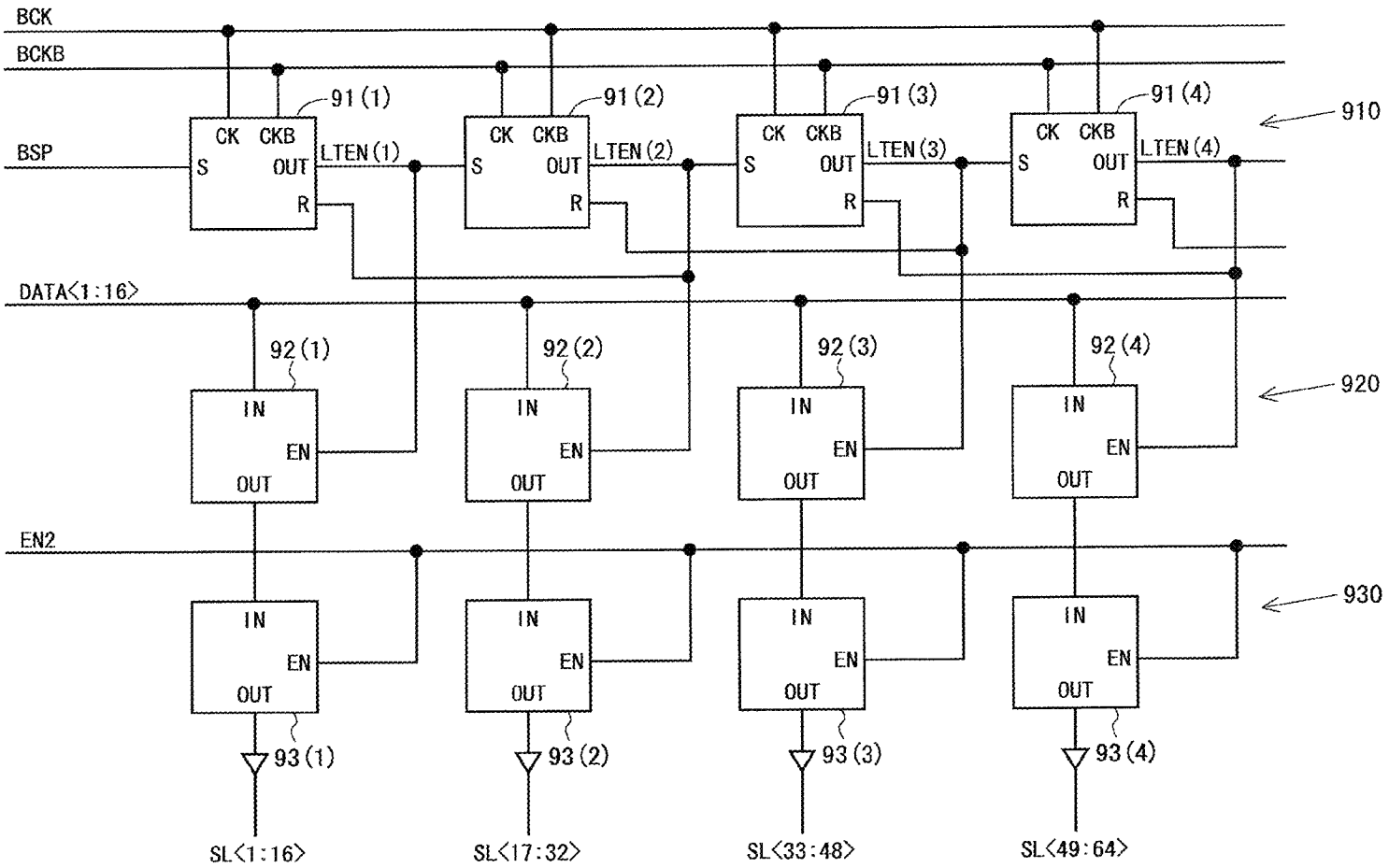
FIG. 26 is a circuit block diagram illustrating a configuration of a portion of a known binary driver.
Figure 27:
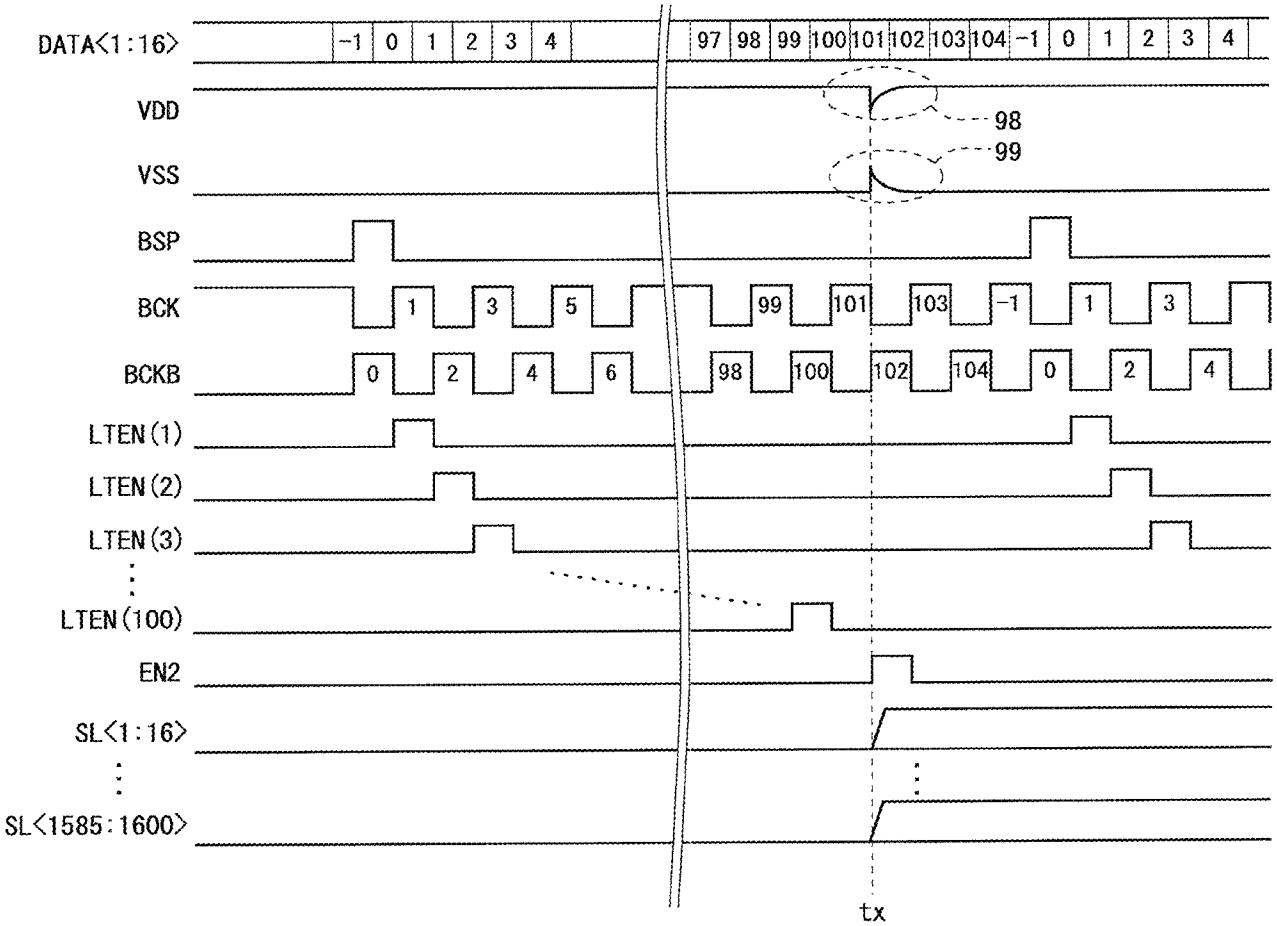
FIG. 27 is a signal waveform diagram for describing the operation of the known binary driver.

FIG. 24 is a signal waveform diagram for describing the operation of the binary driver 30 according to the present embodiment. FIG. 25 is a signal waveform diagram for describing the first latch signal provided to the first latch circuit 32 and the second latch signal provided to the second latch circuit 33. Focusing on the second latch signal in FIG. 25, it is understood that the output signal LIEN (4) from the unit circuit 31 (4) at the fourth stage is provided as the second latch signals L2 (1) in to L2 (3) in to the second latch circuits 33 (1) to 33 (3) at the first to third stages, and it is understood that the output signal LIEN (7) from the unit circuit 31 (7) at the seventh stage is provided as the second latch signals L2 (4) in to L2 (6) in to the second latch circuits 33 (4) to 33 (6) at the fourth to sixth stages.

In the present embodiment, as described above, the output signal LIEN (4) from the unit circuit 31 (4) at the fourth stage is provided as the second latch signal to the second latch circuits 33 (1) to 33 (3) at the first to third stages. Therefore, by the output signal LIEN (4) being set to the high level at the time point t41 (see FIG. 24), the data signal output from the first latch circuits 32 (1) to 32 (3) at the first to third stages are captured in the second latch circuits 33 (1) to 33 (3) at the first to third stages. Then, the data signal captured by the second latch circuits 33 (1) to 33 (3) at the first to third stages is output to the first to 48-th column source bus lines. Thereafter, the data signal is captured in three second latch circuits 33 each time the binary clock signal BCK and the binary clock signal BCKB rise three times together.

At the time point t42 (see FIG. 24), the output signal LIEN (101) from the unit circuit 31 (101) at the 101-th stage is set to the high level, and the data signal output from the first latch circuit 32 (100) at the 100-th stage is captured by the second latch circuit 33 (100) at the 100-th stage. The data signal captured in the second latch circuit 33 (100) at the 100-th stage is output to the 1585 to 1600 column source bus lines.

5.3 Effect

In the present embodiment as well, similar to the first embodiment, a binary driver 30 can be realized in which a voltage drop effect can be effectively reduced while suppressing an increase in circuit size.

6. Other Matters

Although the disclosure has been described in detail above, the above description is exemplary in all respects and is not limiting. It is understood that numerous other modifications or variations can be made without departing from the scope of the disclosure.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A data signal line drive circuit comprising:

a shift register including a plurality of unit circuits connected in series;

a first latch portion including a plurality of first latch circuits configured to operate based on two power supply voltages; and a second latch portion including a plurality of second latch circuits configured to operate based on two power supply voltages, the data signal line drive circuit being configured to output data signals to a plurality of data signal lines, wherein each of the plurality of first latch circuits captures a data signal transmitted from outside, based on a first latch signal, and outputs the captured data signal, each of the plurality of second latch circuits captures a data signal output from a corresponding first latch circuit, based on a second latch signal, and outputs the captured data signal to a corresponding data signal line, each of the plurality of first latch circuits is provided with a shift pulse output from a corresponding unit circuit as the first latch signal, and first latch signals provided to (k+1)-th and subsequent first latch circuits are given as the second latch signal to a k-th second latch circuit, as capturing of data signals at the second latch portion is split into two or more timings, with k as a natural number.

2. The data signal line drive circuit according to claim 1, wherein a first latch signal provided to a (k+p)-th first latch circuit is provided as the second latch signal to the k-th second latch circuit, with p as a particular natural number.

3. The data signal line drive circuit according to claim 1, wherein a same signal is provided as the second latch signal to continuous q second latch circuits, with q as an integer greater than or equal to 2.

4. The data signal line drive circuit according to claim 1, wherein the data signals represent binary data.

5. A liquid crystal display device comprising:

a plurality of pixel circuits including memory circuits configure to hold data, based on the data signals;

a plurality of data signal lines configured to supply the data signals to the plurality of pixel circuits; and a data signal line drive circuit according to claim 1.

* * * * *